US010310422B2

(12) United States Patent
Izawa et al.

(10) Patent No.: US 10,310,422 B2
(45) Date of Patent: Jun. 4, 2019

(54) FIXING APPARATUS AND IMAGE FORMING APPARATUS

(71) Applicant: KONICA MINOLTA, INC., Chiyoda-ku, Tokyo (JP)

(72) Inventors: Tomomi Izawa, Hachioji (JP); Mitsuru Satou, Toyokawa (JP); Kenji Sawada, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/032,142

(22) Filed: Jul. 11, 2018

(65) Prior Publication Data

US 2019/0025739 A1 Jan. 24, 2019

(30) Foreign Application Priority Data

Jul. 20, 2017 (JP) ..... 2017-140747

(51) Int. Cl.
*G03G 15/20* (2006.01)
*G03G 21/20* (2006.01)

(52) U.S. Cl.
CPC ..... *G03G 15/2039* (2013.01); *G03G 15/2017* (2013.01); *G03G 15/2042* (2013.01); *G03G 21/206* (2013.01)

(58) Field of Classification Search
CPC ..... G03G 15/2039; G03G 15/2042; G03G 15/2046; G03G 15/2017; G03G 21/206
See application file for complete search history.

(56) References Cited

U.S. PATENT DOCUMENTS

2006/0088326 A1* 4/2006 Nakayama ..... G03G 15/2046 399/69
2012/0282002 A1* 11/2012 Murasaki ..... G03G 15/2017 399/329
2013/0164015 A1* 6/2013 Kawai ..... G03G 15/2039 399/69
2013/0279932 A1* 10/2013 Ishigai ..... G03G 15/2039 399/69
2014/0023389 A1* 1/2014 Ono ..... G03G 15/2039 399/69

(Continued)

FOREIGN PATENT DOCUMENTS

JP 2006119259 A 5/2006
JP 2016004162 A 1/2016

*Primary Examiner* — Sophia S Chen
(74) *Attorney, Agent, or Firm* — Buchanan Ingersoll & Rooney PC

(57) ABSTRACT

A fixing apparatus feeds a sheet that is unfixed through a nip formed between a heating member and a pressurizing member to thermally fix the sheet, and includes a cooler that cools the pressurizing member, wherein when a fixing job is performed on a sheet whose sheet width is a second width larger than a first width, after a fixing job is completed on a sheet whose sheet width in an orthogonal direction to a sheet feeding direction is the first width, the cooler cools a difference region in which a first sheet feeding region of the pressurizing member through which the sheet having the first width is fed and a second sheet feeding region through which the sheet having the second width is fed are not overlapped with each other, with a cooling power stronger than that of a region corresponding to the first sheet feeding region.

13 Claims, 18 Drawing Sheets

(56) References Cited

U.S. PATENT DOCUMENTS

| | | | | |
|---|---|---|---|---|
| 2014/0286665 | A1* | 9/2014 | Minagawa | G03G 15/2042 399/69 |
| 2018/0157003 | A1* | 6/2018 | Tsuchihashi | G03G 15/2042 |

* cited by examiner

SMALL SIZE
L1
42
T2
OR SHORTER
T1
T2
OR SHORTER
TARGET TEMPERATURE
OVERALL COOLING: T1[°C]
END PORTION COOLING: T2[°C]
T1 < T2

LARGE SIZE
L2
L1
IMAGE NOISE (BLISTER) GENERATION
A
A
42
T2
OR SHORTER
T1
T2
OR SHORTER
A
T2
T1
T1
A
T2
T1
SMALL SIZE ⇒ LARGE SIZE

FIXING APPARATUS AND IMAGE FORMING APPARATUS

The entire disclosure of Japanese patent Application No. 2017-140747, filed on Jul. 20, 2017, is incorporated herein by reference in its entirety.

BACKGROUND

Technological Field

The present invention relates to a fixing apparatus and an image forming apparatus provided with the fixing apparatus, and more particularly to a technique of suppressing a pressurizing member of the fixing apparatus from deviating from an appropriate temperature range.

Description of the Related Art

In an electrophotographic image forming apparatus, an electrostatic latent image is formed by exposing and scanning a surface of a photoreceptor on the basis of image data of a document, a toner is supplied to the electrostatic latent image to generate a toner image, and the toner image is thermally fixed by a fixing apparatus after being transferred onto a sheet.

Generally, in a fixing apparatus, a sheet is fed through a nip part formed between a heating roller (heating member) and a pressurizing roller (pressurizing member) pressed against the heating roller, and the sheet is conveyed forward while being thermally fixed. In a region where the sheet is fed in an axial direction of each roller (hereinafter referred to as "sheet feeding region"), a large amount of heat is taken away by a sheet, particularly by a toner on the sheet. In a region where the sheet is not fed (hereinafter, referred to as a "non-sheet feeding region"), almost no heat is taken away. Thus, when the heating roller is heated by a heater in order to keep temperature of the nip part in the sheet feeding region at predetermined fixing temperature, temperature in the non-sheet feeding region rises more than necessary.

Therefore, as a conventional technique, a fixing apparatus has been proposed in which a sheet of a currently performed print job is cooled by blowing air to the non-sheet feeding region of the heating roller (see, for example, JP 2016-4162 A and JP 2006-119259A).

Even though the non-sheet feeding region is cooled by air, from the viewpoint of energy saving, the temperature is conventionally maintained to a degree slightly lower than endurance temperature of components of each part of the fixing apparatus (for example, about 230° C.).

In particular, in the conventional method described above, when a sheet width in the print job performed immediately before the current print job is smaller than a sheet width in the current print job, a region that is the non-sheet feeding region with the previous sheet width becomes the sheet feeding region with the current sheet width. Thus, the heating roller contacts with the sheet while the temperature in a difference region (hereinafter, referred to as "difference region") between the sheet feeding region with the previous sheet width and the sheet feeding region with the current sheet width is maintained at high temperature of 230° C.

Normally, the heating roller is designed so as to reduce heat capacity thereof in order to shorten warm-up time and save energy. On the other hand, the pressurizing roller has a larger thickness of an elastic layer on the surface than the heating roller, so that a nip width is increased, and the heat capacity is also increased by that amount. In addition, since the heating roller directly contacts with the toner image, the heat is liable to be taken away. However, since the pressurizing roller contacts with the surface on the back surface of the sheet where the toner image is not formed, the temperature hardly falls.

If the difference region described above of the pressurizing roller contacts with the back surface of the sheet at the nip part while being maintained at high temperature, a problem of image noise called a blister (a phenomenon that the gloss of the toner image is degraded and the toner image appears to be clouded) occurs in the fixed image.

SUMMARY

The present invention has been made in view of the above circumstances, and an object of the present invention is to provide a fixing apparatus that suppresses generation of image noise in a difference region when fixing a sheet having a width larger than a width of a previously fixed sheet, and to provide an image forming apparatus provided with the fixing apparatus.

To achieve the abovementioned object, according to an aspect of the present invention, there is provided a fixing apparatus for feeding a sheet that is unfixed through a nip formed between a heating member and a pressurizing member to thermally fix the sheet and the fixing apparatus reflecting one aspect of the present invention comprises a cooler that cools the pressurizing member, wherein when a fixing job is performed on a sheet whose sheet width is a second width larger than a first width, after a fixing job is completed on a sheet whose sheet width in an orthogonal direction to a sheet feeding direction is the first width, the cooler cools a difference region in which a first sheet feeding region of the pressurizing member through which the sheet having the first width is fed and a second sheet feeding region through which the sheet having the second width is fed are not overlapped with each other, with a cooling power stronger than that of a region corresponding to the first sheet feeding region.

BRIEF DESCRIPTION OF THE DRAWINGS

The advantages and features provided by one or more embodiments of the invention will become more fully understood from the detailed description given hereinbelow and the appended drawings which are given by way of illustration only and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Hereinafter, an example in which a fixing apparatus according to the embodiment of the present invention is applied to a fixing part of a tandem type color copying machine (hereinafter, simply referred to as "copying machine") will be described.

(1) Overall Configuration of Copying Machine

Figure 1:
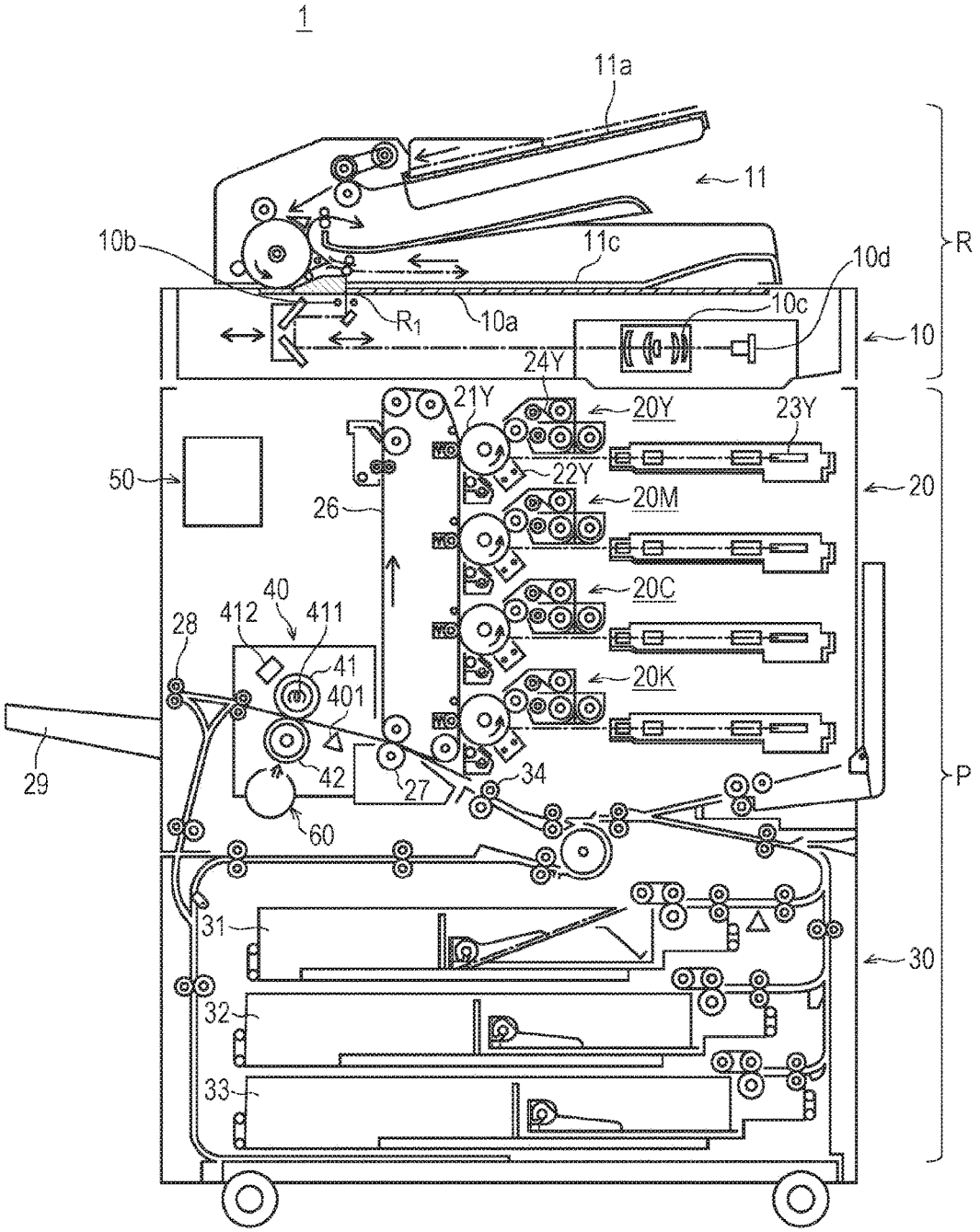
FIG. 1 is a schematic view for explaining a configuration of a tandem type color copying machine that is an example of an image forming apparatus according to an embodiment of the present invention.

FIG. 1 is a schematic view for explaining a configuration of a copying machine 1 according to the present embodiment.

As shown in the drawing, the copying machine 1 is roughly composed of an image reader part (document reading device) R and a printer part (image forming apparatus) P.

<Image Reader Part>

An image reader part R includes a scanner part 10 that optically reads a document image and converts the document image into an image signal, and a document conveyance part (ADF unit) 11 provided above the scanner part 10.

The document conveyance part 11 feeds documents one by one from a document bundle set in a document feed tray 11*a*, conveys the documents to a reading position R1 on a platen glass 10*a*, and discharges the documents onto a document discharge tray 11*c* after a document image is scanned by the scanner part 10 at the reading position R1.

In the scanner part 10, light is emitted from a linear light source 10*b* formed of an LED array or the like, and reflected light from documents passing through the reading position R1 is focused on a line sensor 10*d* via a condenser lens group 10*c*.

The line sensor 10*d* is formed by arranging a plurality of charge coupled devices (CCDs) in a straight line in a direction parallel to a main scanning direction, converts reflected light from the document in which light has been incident, into an electrical signal, and outputs the electric signal to the control part 50 of a printer part P.

<Printer Part>

The printer part P includes an image forming part 20, a sheet feeding part 30, a fixing part 40, a control part 50, and the like, and forms an image on the sheet based on a document image read by the image reader part R, and image data transmitted from another terminal via a network.

The image forming part 20 includes an intermediate transfer belt 26 that is rotatably driven in an arrow direction by a driving source not shown, and process units 20Y, 20M, 20C. 20K that are provided in an array along a travelling surface of a vertical direction of the intermediate transfer belt 26.

The process units 20Y, 20M, 20C, 20K form toner images of respective colors of yellow (Y), magenta (M), cyan (C), and black (K).

Since these process units 20Y to 20K have the same configuration except for colors of toners to be used, only the configuration of the process unit 20Y will be described as a representative.

The process unit 20Y has a charger 22Y, an exposure device 23Y, a developing device 24Y, and the like disposed around the photosensitive drum 21Y.

An outer peripheral surface of the photosensitive drum 21Y is uniformly charged by the charger 22Y.

The exposure device 23Y modulates and drives a laser light source based on image data (or image data included in a received print job) acquired by the image reader part R to expose and scan the surface of the charged photosensitive drum 21Y. As a result, an electrostatic latent image is formed on the outer peripheral surface of the photosensitive drum 21Y.

The electrostatic latent image is developed with a yellow toner by the developing device 24Y and transferred onto the intermediate transfer belt 26.

A color image is formed by superimposing and transferring the toner images of M, C. and K colors formed on the photosensitive drums in the other process units 20M. 20C, and 20K to the same position on the intermediate transfer belt 26.

The toner image transferred onto the intermediate transfer belt 26 is conveyed to a secondary transfer position opposed to the secondary transfer roller 27 by the circulating motion of the intermediate transfer belt 26.

On the other hand, a sheet feeding part 30 has paper feeding cassettes 31 to 33, feeds out a sheet from a designated paper feeding cassette, and conveys the sheet to the secondary transfer position at timing by a registration roller 34, and the toner image on the intermediate transfer belt 26 is secondarily transferred onto the sheet.

The sheet to which the toner image has been transferred passes through the nip part formed by the heating roller 41 and the pressurizing roller 42 of the fixing part 40, is thermally fixed, and thereafter, is discharged onto the discharge tray 29 via the discharge roller 28. A halogen heater 411 is built in the heating roller 41.

A temperature sensor 412 such as a thermistor is disposed in order to detect surface temperature of a substantially center portion of the heating roller 41 in a longitudinal direction (rotational axis direction). A photoelectric sheet feeding sensor 401 is disposed on an upstream side of a sheet conveyance direction of the nip part of the fixing part 40.

The cooling device 60 is for cooling the pressurizing roller 42 to appropriate temperature.

(2) Configuration of Cooling Device 60

Figure 2:
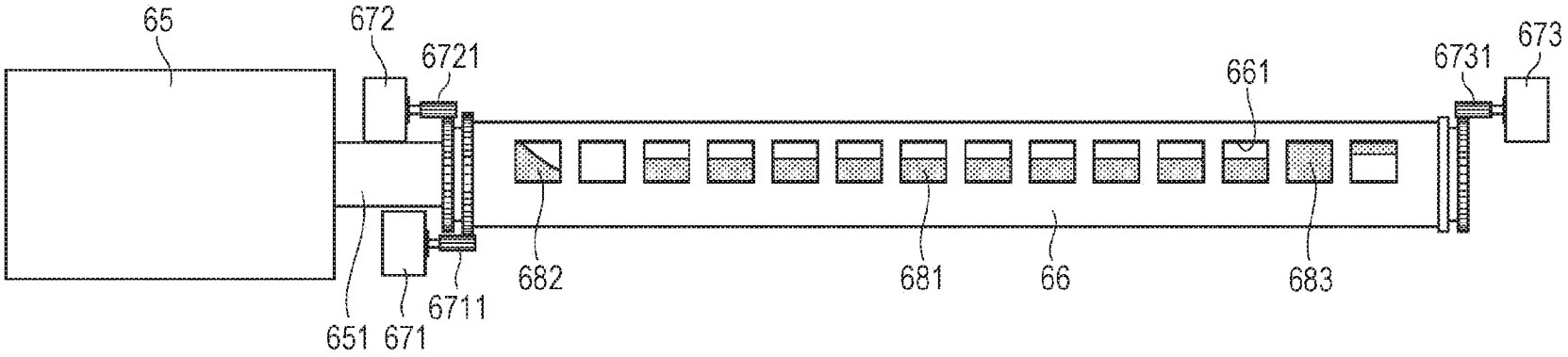
FIG. 2 is a view for explaining a configuration of a cooling device provided in the copying machine.

FIG. 2 is a front view showing a configuration of the cooling device 60.

The cooling device 60 includes a fan device 65, an air blowing sleeve 66, first to third shutter members 681 to 683, drive motors 671 to 673 for rotationally driving the first to third shutter members 681 to 683, and the like.

The air flow generated by the fan device 65 is sent to the cylindrical air blowing sleeve 66 via a duct 651. The length of the air blowing sleeve 66 is substantially the same as the length of the pressurizing roller 42, is parallel to the rotation axis of the pressurizing roller 42, and is disposed in an almost opposite position from the nip part composed of the heating roller 41 and the pressurizing roller 42, with respect to the pressurizing roller 42 (see FIG. 1).

A plurality of rectangular windows 661 are formed at predetermined intervals along the longitudinal direction at positions opposed to the pressurizing roller 42 on the peripheral surface of the air blowing sleeve 66. Air is blown toward the peripheral surface of the pressurizing roller 42 from each window 661 to cool the pressurizing roller 42.

The opening amount of each window 661 is regulated by the first to third shutter members 681 to 683, and the air blowing volume is controlled.

Figure 3A:
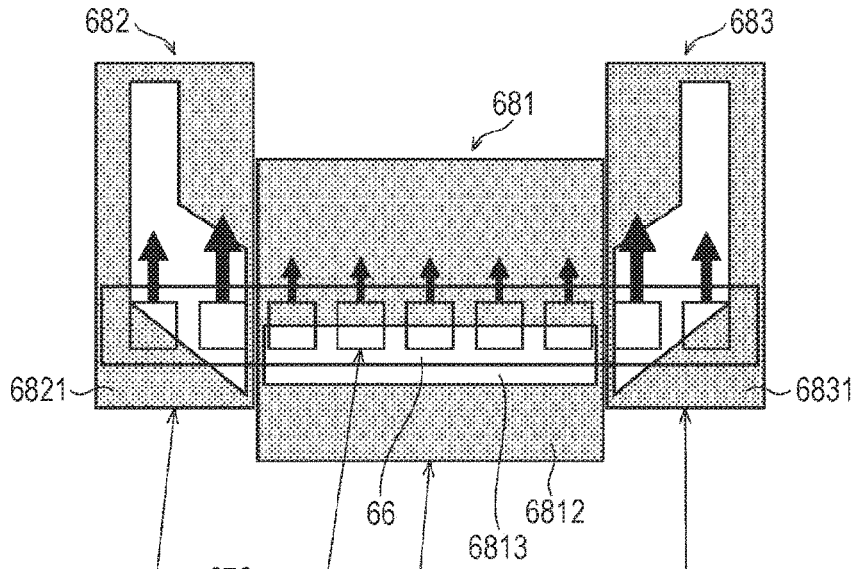
FIG. 3A is a schematic view of when cylindrical first to third shutter members are deployed.
Figure 3B:
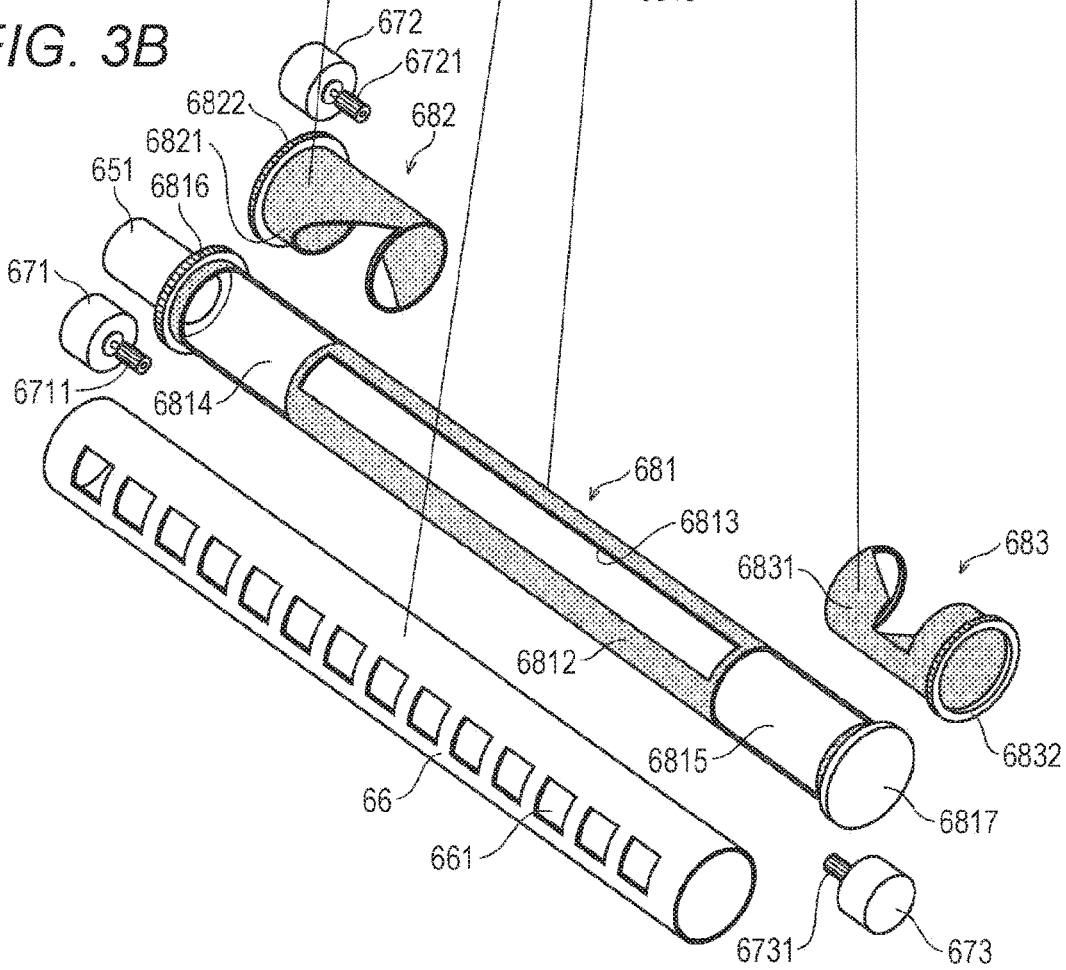
FIG. 3B is an exploded perspective view of the cooling device.
Figure 4A:
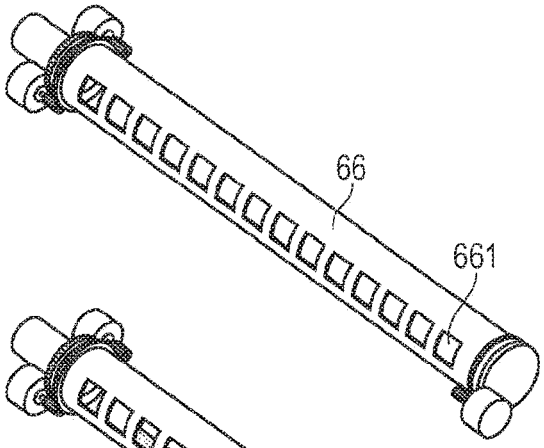
FIGS. 4A to 4E are diagrams for showing examples of shielding states of a plurality of windows by the first to third shutter members.
Figure 4B:
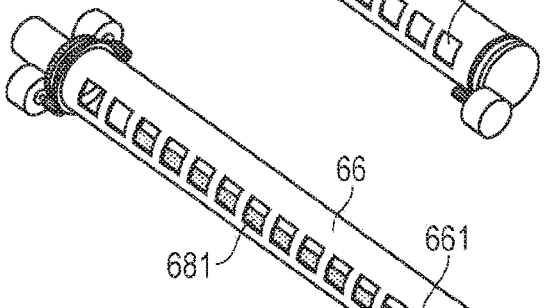
Figure 4C:
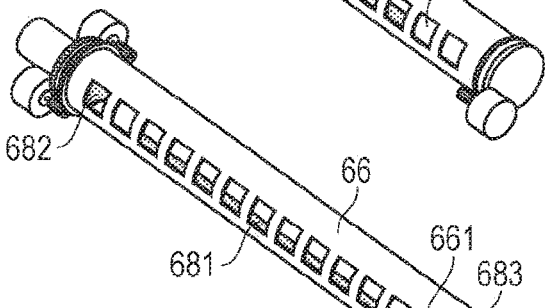
Figure 4D:
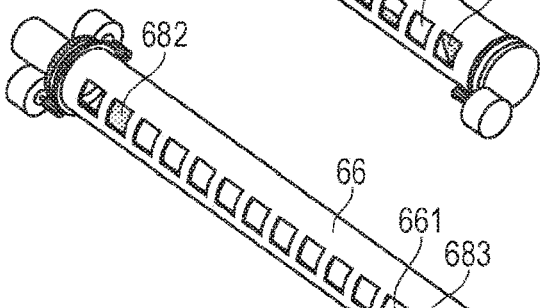
Figure 4E:
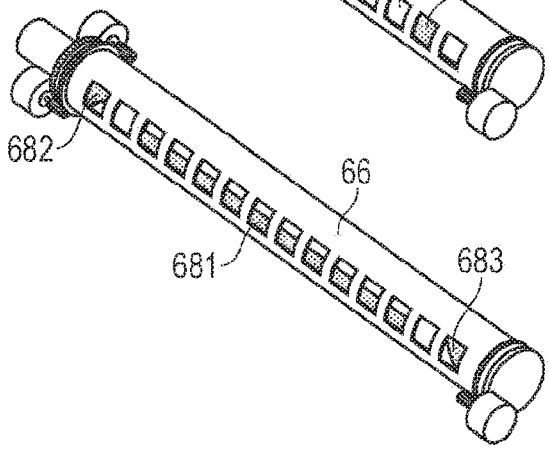

FIG. 3B is an exploded perspective view of another part of the cooling device 60 excluding the fan device 65.

In the present embodiment, for the sake of convenience, a configuration of the cooling device 60 in which the sheet widths (the widths in the direction orthogonal to the sheet feeding direction of the sheet) are two widths of a first size L1 and a second size L2 (L1<L2), will be described. In addition, it is assumed that feeding of the sheet is performed with center reference sheet feeding (feeding of the sheet in a state where the center in the sheet width direction is the same even when the sheet size is different).

As shown in FIG. 3B, the first shutter member 681 is formed by cutting out both end portions 6814, 6815 of the peripheral surface of the cylindrical member by approximately half the circumference so that an opening 6813 is formed in a center portion 6812.

The length in the longitudinal direction of the opening 6813 is substantially equal to the first size L1 and the length in a transverse direction of the opening 6813 is set to be the same as or slightly larger than the length in the peripheral direction of the window 661 of the air blowing sleeve 66 (see the developed image of the shutter in FIG. 3A).

A gear 6816 is formed at a boundary between the first shutter member 681 and the duct 651 so as to be engaged with a pinion gear 6711 mounted on a drive axis of the drive motor 671.

The second and third shutter members 682, 683 are symmetrical with respect to the longitudinal direction of the air blowing sleeve 66, and as shown in the developed view of FIG. 3A, each of the portions 6821, 6831 of the second and third shutter members 682, 683 surrounding openings therein openings thereof is composed of a portion orthogonal to an inclined portion with respect to the axis of the air blowing sleeve 66.

Gears 6822, 6832 are formed at the end portions of the second and third shutter members 682, 683, respectively, and are engaged with pinion gears 6721, 6731 mounted on drive axes of the drive motors 672, 673, respectively.

In order to attach the first to third shutter members 681 to 683 to the air blowing sleeve 66 in such cooling device 60, first, the second and third shutter members 682, 683 are inserted from both end portions of the air blowing sleeve 66, a cap 6817 of the first shutter member 681 is removed, the first shutter member 681 is inserted into the air blowing sleeve 66 and the second and third shutter members 682 and 683, and finally, the cap 6817 is mounted to the end portion of the first shutter member 681.

FIGS. 4A to 4E show an example in which an opening area of each window 661 of the air blowing sleeve 66 is variously changed by rotating the first to third shutter members 681 to 683 in the air blowing sleeve 66.

Figures 5A, 5B:
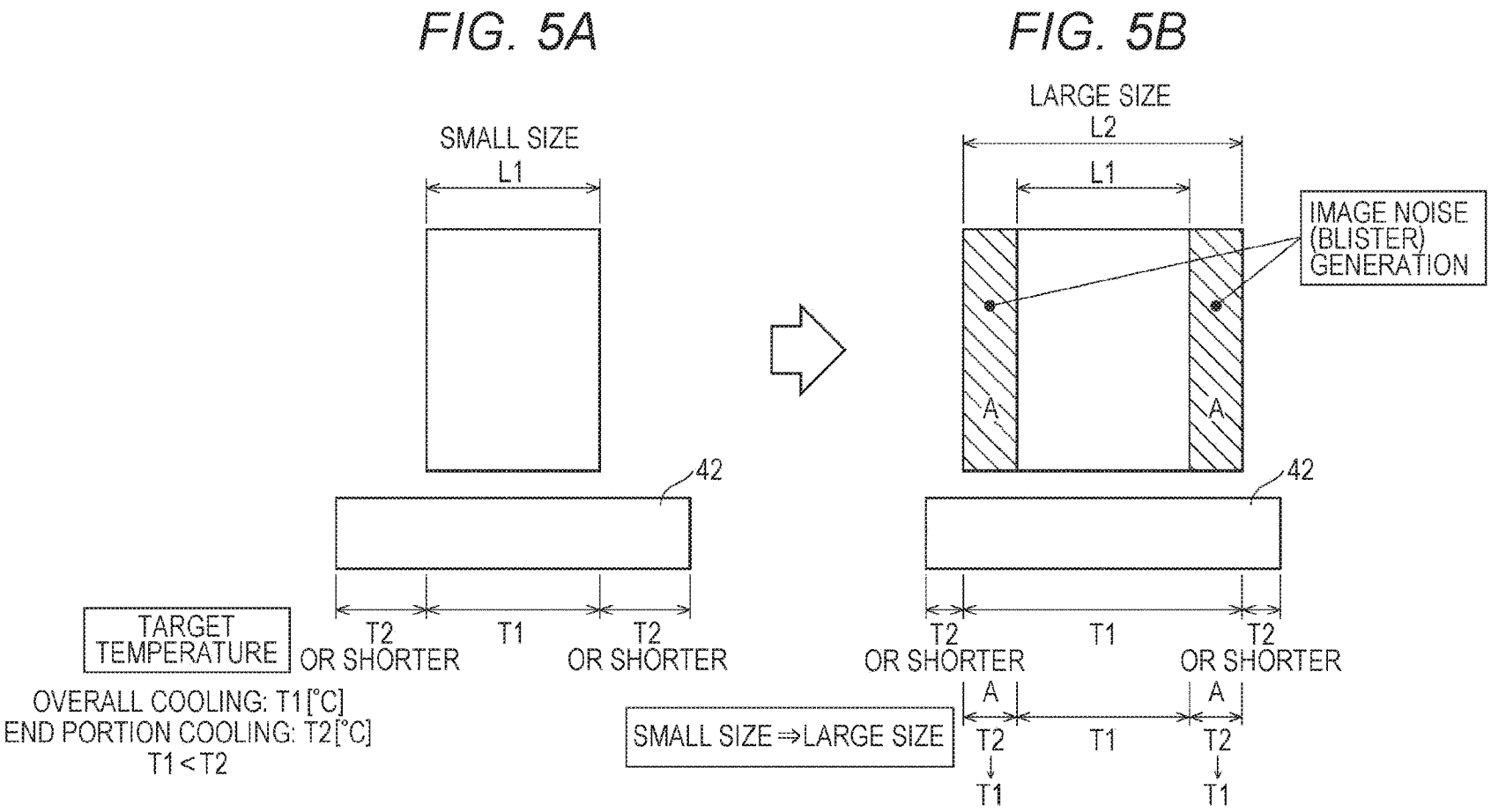
FIGS. 5A and 5B are schematic diagrams showing a temperature state of a difference region and a non-sheet feeding region of when a large size sheet is fixed after a small size sleet of is fixed.

FIGS. 5A and 5B are schematic diagrams showing a state of temperature distribution in an axial direction of the pressurizing roller 42 of when switching is performed from a fixing job of predetermined pieces of small width sheets (hereinafter, referred to as "small size" sheet) to a fixing job of a large width sheet (hereinafter, referred to as "large size" sheet), and the fixing job is performed, in the fixing part 40.

As shown in FIG. 5A, in the case of a small size sheet, the cooling device 60 blows air to a sheet feeding region of the width L1 to temperature T1 (about 60° C. to 120° C.), and cools the other region (non-sheet feeding region) so that the temperature is temperature T2 or lower (about 230° C.: T2>T1) that is a degree having no problem with durability of the pressurizing roller 42, since the other region has no influence on a fixed image quality.

Then, when a large size sheet of the width L2 is fed as the next fixing job, target temperature of the sheet feeding region of the pressurizing roller 42 is set to T1 as shown in FIG. 5B. However, since a region shown by oblique lines (a difference region between the sheet feeding region for the small size sheet and the sheet feeding region for the large size sheet) A is a non-sheet feeding region in the case of a small size sheet fixing job, the temperature is T2, and this portion needs to be quickly lowered to the target temperature T1.

Figure 6A:
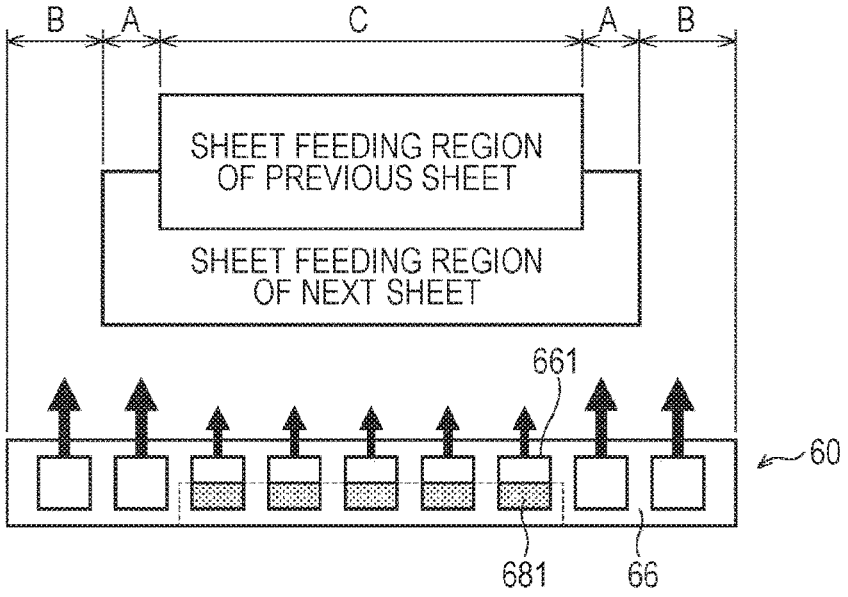
FIG. 6A is a schematic diagram showing a situation of increasing air volumes in the difference region and the non-sheet feeding region of when the large size sheet is fixed after the small size sheet is fixed in the cooling device.

FIG. 6A is a diagram schematically showing a magnitude of the air blowing volume from each window 661 by the cooling device 60 at this time. The size of the arrow indicates the magnitude of the air blowing volume (that is, a cooling power).

As shown in the drawing, the window 661 that is in a range corresponding to a region where sheet feeding regions of a previous sheet and a next sheet overlap (Hereinafter referred to as "overlapping region". This overlapping region is equal to the previous small size sheet width) C is shielded by the first shutter member 681 by about half, and the window 661 corresponding to ranges of a difference region A and a non-sheet feeding region B of the large size sheet, are made to have the large cooling power by fully opening the second and third shutter members 682, 683.

Figure 6B:
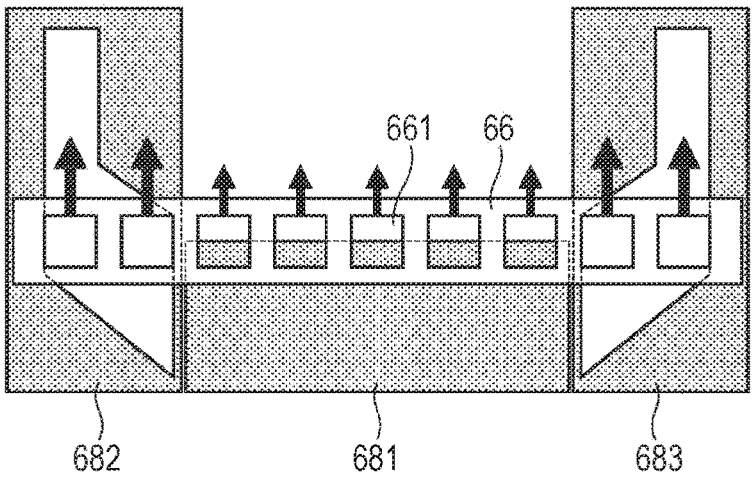
FIG. 6B is a developed view showing a positional relationship between the first to third shutter members and windows of an air blowing sleeve of when the air volumes are controlled in that way.

FIG. 6B is a schematic diagram showing a relationship between the developed view of the first to third shutter members 681 to 683 and each window 661 of the air blowing sleeve 66, in this state.

The air blowing volume in the difference region A of the cooling device 60 is made larger than the air blowing volume of an overlapping region C in this manner, and thereby, the temperature of the difference region that is the temperature T2 higher than the temperature T1 can be quickly lowered to the temperature T1, and occurrence of image noise such as blisters in the difference region A is suppressed.

Such control of the air blowing volume of the cooling device 60 is performed by the control part 50.

(3) Configuration of Control Part

Figure 7:
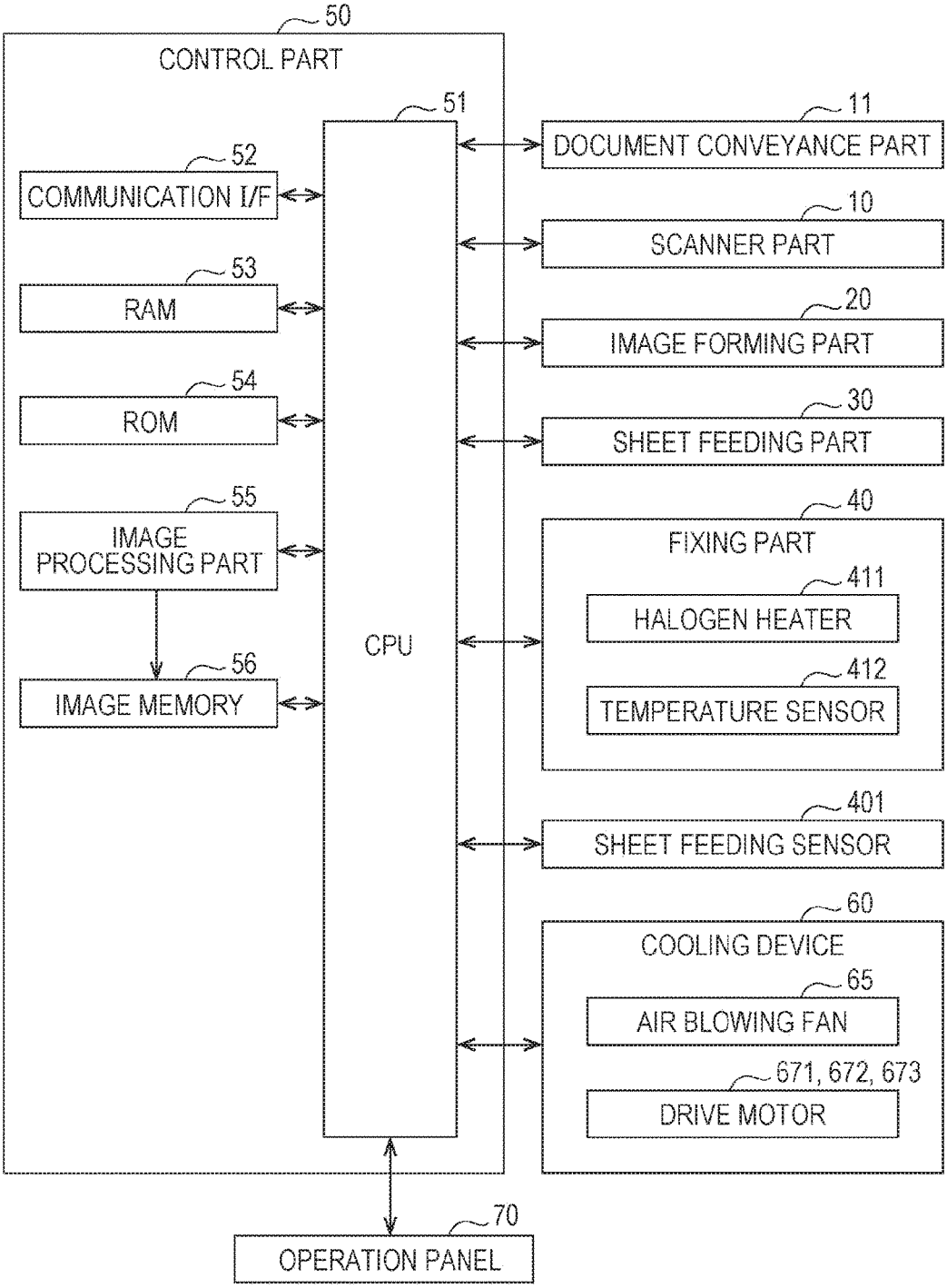
FIG. 7 is a block diagram showing a configuration of a control part of the copying machine.

FIG. 7 is a block diagram showing a main configuration of the control part 50 of the copying machine 1.

As shown in the drawing, the control part 50 includes a central processing unit (CPU) 51, a communication interface (I/F) 52, a random access memory (RAM) 53, a read only memory (ROM) 54, an image processing part 55, an image memory 56, and the like.

The CPU 51 reads the control program from the ROM 54 at the time of turning on the power to the copying machine 1 and executes the control program with the RAM 53 as a work storage region.

The CPU 51 accepts a print job from another external terminal via a communication network such as a LAN by the communication I/F 52.

The data of the print job received from the external terminal and the image data of R, G, and B read by the scanner part 10 is converted into density data of Y, C. M and K that are development colors, by the image processing part 55, subjected to known image processing such as edge enhancement and smoothing processing, and then stored in the image memory 56.

The CPU 51 controls operation of the image forming part 20, the sheet feeding part 30, and the fixing part 40 so as to smoothly perform printing operation, based on the image data of the document read by the scanner part 10 and the image data of the print job accepted from the external terminal via the communication I/F 52.

The temperature sensor 412 detects the surface temperature at the center portion in the axial direction of the heating roller 41. The control part 50 controls the electric power to be transmitted to the halogen heater 411 based on the temperature detected by the detected temperature so that the heating roller 41 reaches target fixing temperature.

The control part 50 monitors the sheet size related to the fixing job and controls the drive motors 671 to 673 of the cooling device 60, thereby adjusting the opening area of each window 661, so that temperature in each region of the pressurizing roller 42 is appropriate temperature.

(4) Air Blowing Volume Control of Cooling Device

Figure 8:
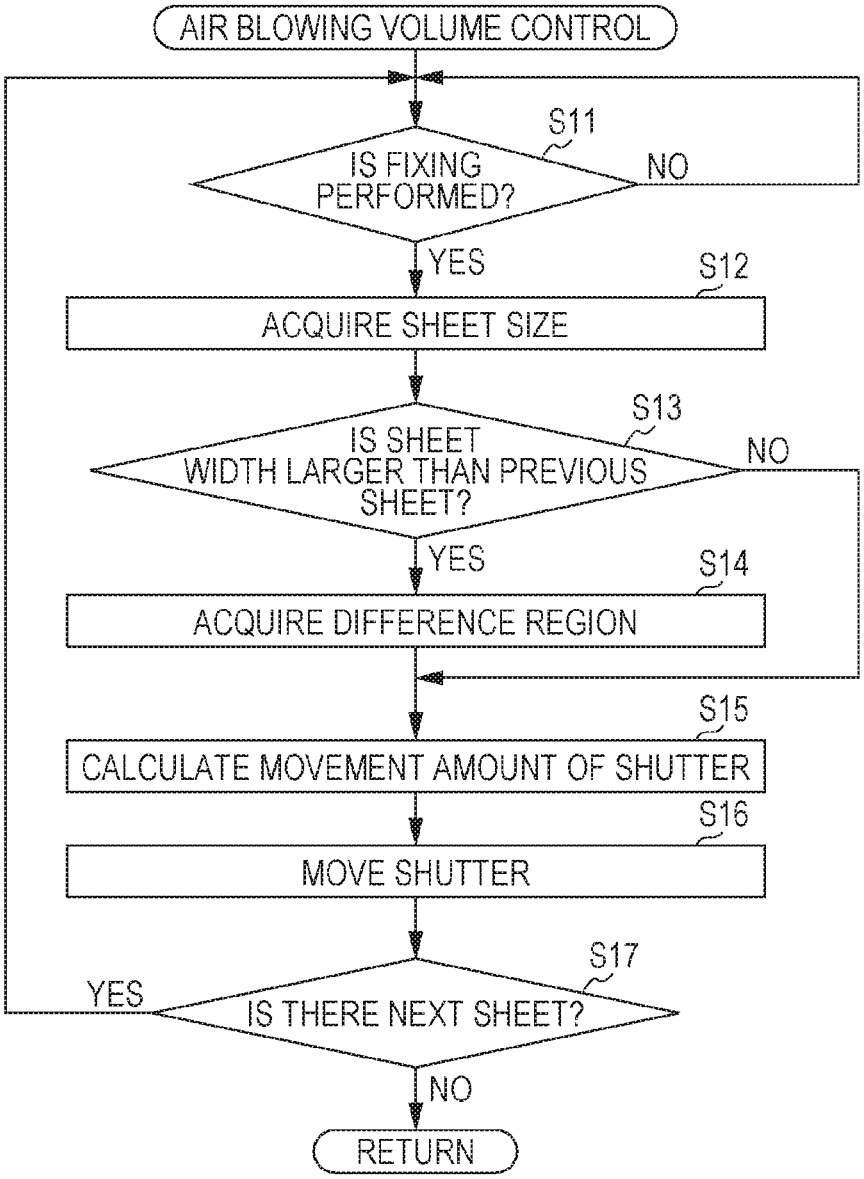
FIG. 8 is a flowchart showing contents of air blowing volume control of the cooling device by the control part.

FIG. 8 is a flowchart showing the procedure of the air blowing volume control of the cooling device 60 performed by the control part 50 This flowchart is performed as a subroutine of a main flowchart (not shown) for controlling the operation of the entire copying machine 1.

In this flowchart, a case where a mixed job (a job in which printing of the large size sheet and printing of the small size sheet are mixed in a series of jobs) is performed for sheets of two types of sheet widths, will be described.

First, whether fixing is to be performed for the next sheet is determined (step S11). In the present embodiment, for example, when a leading end of the sheet to be fixed next is detected by the sheet feeding sensor 401 (see FIG. 1) arranged immediately front of the nip part of the fixing part 40, in an upstream side of a sheet conveyance direction, it is determined to be "YES".

When it is determined in step S11 that fixing is to be performed (YES in step S11), the size of the next sheet (the sheet size here is sufficient with only information on sheet width) is acquired (step S12).

The sheet size can be acquired by the following method. First, when the job is a print job issued by an external terminal, since information on the sheet size is included in a header portion of the data of the print job, the sheet size can be acquired by reading the information by the control part 50.

In addition, when the job is a copy job, since a document size detection part is generally provided in the document conveyance part 11 or the scanner part 10, the corresponding sheet size can be obtained by acquiring a detection result of the detection part.

When a paper feeding cassette is selected and a print job is performed, the sheet size can be specified by a size detection sensor provided in the paper feeding cassette.

Alternatively, a sheet width detection part for detecting the sheet size may be separately provided in the middle of the conveyance path leading to the nip part of the fixing part 40.

When the sheet size of the sheet to be fixed next is acquired in step S12, whether this sheet is larger than the sheet width previously fixed, is determined (step S13).

The sheet size acquired in step S12 is temporarily stored in the RAM 53 and is used for comparison with the sheet width of the next sheet in step S13.

When it is determined to be "YES" in step S13, information on the difference region between the sheet related to the previous fixing and the sheet to be fixed next is acquired (step S14).

When the sheet widths of the previous time and the next time are specified, the difference region can be easily determined by comparing the sheet widths, and the window 661 corresponding to the difference region is specified. It is preferable that the size and interval of each window 661 are determined such that at least one window 661 is substantially opposed to the difference region of various sheet sizes.

Then, from the information on the difference region, the movement amount (rotation amount) of the first to third shutter members 681 to 683 is calculated (step S15). In the case of the present embodiment, as shown in FIG. 6A, the opening ratios of the window 661 corresponding to the difference region A and the non-sheet feeding region B of the next sheet are equally maximized, and the opening ratio of the overlapping region C (that is, the sheet feeding region of the small size sheet) is set to approximately 50%.

FIG. 6B is a schematic diagram showing the positions of the first to third shutter members 681 to 683 in developed view, of when the opening ratio of each window 661 is set as described above.

The drive motors 671 to 673 (FIG. 2) are driven to rotate and move each of the first to third shutter members 681 to 683 by the calculated movement amount (step S16).

A well-known technique is applied to the rotation control of each of the drive motors 671 to 673.

For example, when a stepping motor is used as the drive motors 671 to 673, since a rotation angle can be controlled by the number of drive pulses output to the stepping motor, the reference position (home position) is first determined, a drive pulse of the predetermined count number is output from the reference position to a driver (not shown) of the stepping motor, and thereby, the rotation amount can be controlled.

When the drive motors 671 to 673 are DC motors incorporating encoders, the rotation amount can also be controlled by counting the output pulses of the encoder from the reference position.

A table related to the opening ratio (or the movement amounts of the first to third shutter members 681 to 683) of the window 661 corresponding to the sheet widths of the previous sheet and the next sheet and the difference region A, the non-sheet feeding region B, and the overlapping region C at that time, is stored in the ROM 54, and the CPU 51 refers to the table and performs step S16.

In step S13, if the sheet width of the next sheet is not larger than the previous sleet (NO in step S13), that is, (a) when the sheet width of the next sheet has the same sheet width as the previous sheet, or (b) when the sheet width of the next sheet is smaller than the sheet width of the previous sheet, step S14 is skipped, the process moves to step S15, and the movement amount of the shutter is calculated.

In the case of (a), the air blowing volume from each window 661 is not particularly changed, and in the case of (b), an opening area of each window 661 is set so that the cooling power of the non-sheet feeding region is stronger than the sheet feeding region for the small size sheet.

When fixing of the current sheet is completed, the presence or absence of the next sheet is determined (step S17). If there is a next sheet (YES in step S17), steps S11 to S16 are repeated. If there is no next sheet, the air blowing volume control is terminated and the process returns to the main flow chart.

If the number of continuous fixing sheets of the large size sheet after the small size increases, the temperature in the difference region A may be lower than the lower limit of the appropriate range (60° C. to 120° C.). For such a case, a temperature sensor that detects the surface temperature of the pressurizing roller 42 in the difference region A is provided, the detection result is monitored, and before the temperature in the difference region A reaches the lower limit of the appropriate range, the air blowing volume may be controlled so as to be the same as that of the overlapping region C.

As described above, according to the present embodiment, when the large size sheet fixing job is performed after the previous small size sheet fixing job, the air blowing volume in the difference region A of the pressurizing roller 42 is set to larger than the air blowing volume to the overlapping region C where sheet feeding regions for the small size and the large size sheets are superimposed so that the cooling capacity for the difference region A is increased. Thus, the occurrence of image noise such as blisters in the difference region A can be suppressed.

<Modification>

Although the present invention has been described on the basis of the embodiment, the present invention is of course not limited to the embodiment described above, and the following modifications are conceivable.

(1) In the above embodiment, the air blowing volume in the overlapping region C is made constant. However, when the small size sheet fixing job is continuously performed, in the large size sheet fixing job performed thereafter, the temperature of the overlapping region C of the pressurizing roller 42 may be lower than the appropriate range. When only the fixing of a sheet having a low toner density is performed many times, the temperature in the sheet feeding region may be higher than the appropriate range.

Therefore, in the present modification, the temperature of the overlapping region C of the pressurizing roller 42 is detected, and the air blowing volume in the overlapping region C is also changed on the basis of the detection.

In this modification, a temperature sensor (not shown) that detects the temperature of the surface of the sheet feeding region (desirably, the axial center portion) for the small size sheet of the pressurizing roller 42 is provided.

Figure 9:
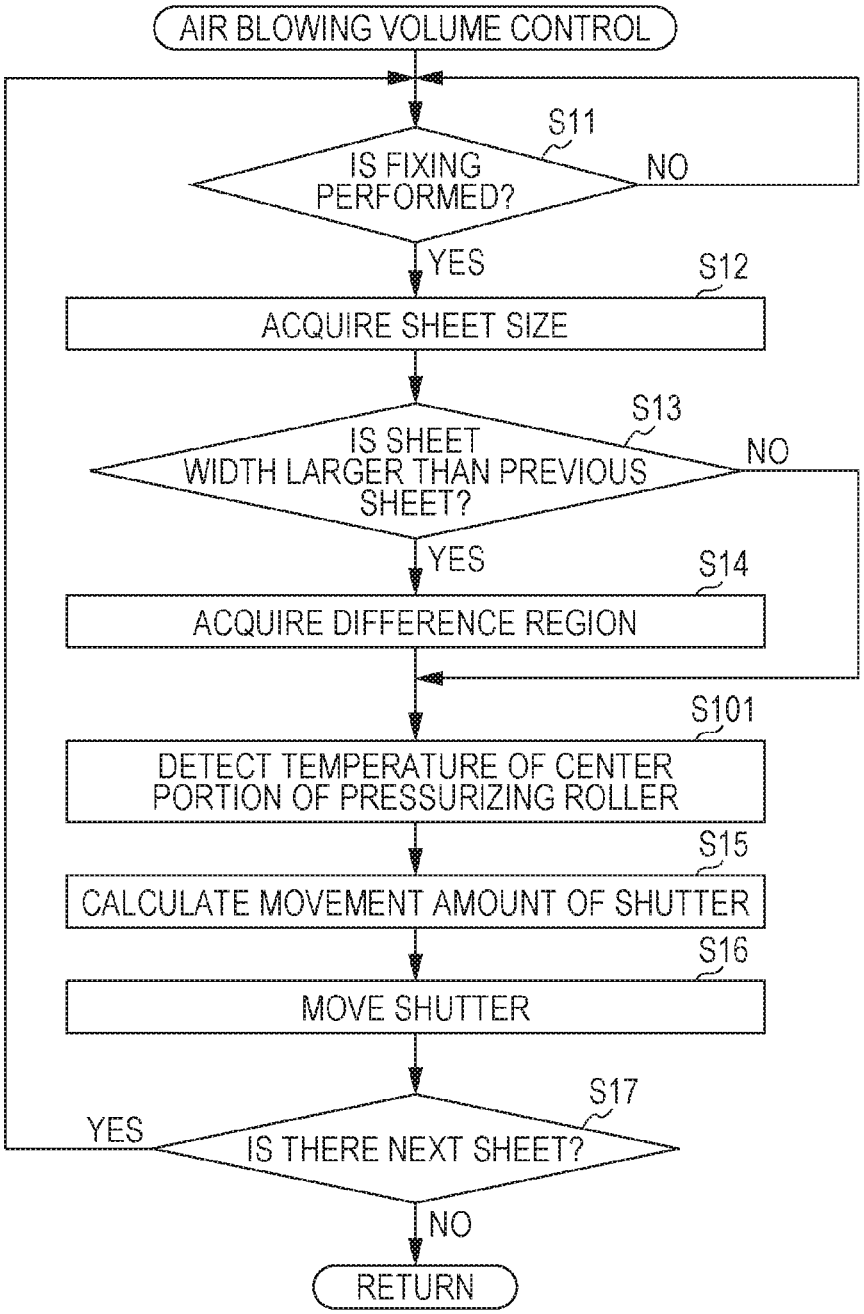
FIG. 9 is a flowchart showing contents of a first modification of the air blowing volume control of the cooling device.

FIG. 9 is a flowchart showing the procedure of the air blowing volume control performed by the control part 50 in the present modification.

What is greatly different from the flowchart in FIG. 8 is that step S101 of detecting the pressurizing roller center portion temperature is inserted after the difference region is acquired in step S14.

In the calculation of the movement amount of the shutter in step S15, first, based on the information on the difference region acquired in step S14, the movement amounts of the second and third shutter members 682, 683 are determined so that the air blowing volumes in the difference region A and the non-sheet feeding region B are increased, and when the detected temperature in step S101 is lower than predetermined temperature (for example, 60° C.), the movement amount of the first shutter member 681 is determined so that the air blowing volume in the overlapping region C is decreased, and when the detected temperature in step S101 is higher than predetermined temperature (for example, 120° C.), the movement amount of the first shutter member 681 is determined so that the air blowing volume in the overlapping region C is increased.

For example, a table related to the movement amount of the first shutter member 681 is stored in the ROM 54 in association with the temperature of the overlapping region C. and the CPU 51 determines the movement amount of the first shutter member 681 based on the table.

Then, the movement of the corresponding shutter member is performed based on the above determined movement amounts of the first to third shutter members 681 to 683 (step S16).

Since the other steps are the same as those in FIG. 8, the description thereof will be omitted.

Figure 10A:
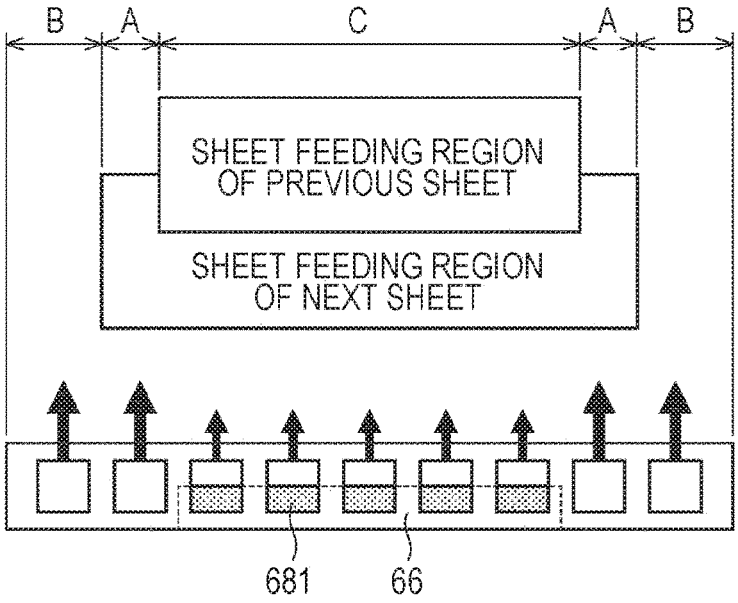
FIGS. 10A and 10B are diagrams schematically showing an air blowing volume controlled in the first modification.
Figure 10B:
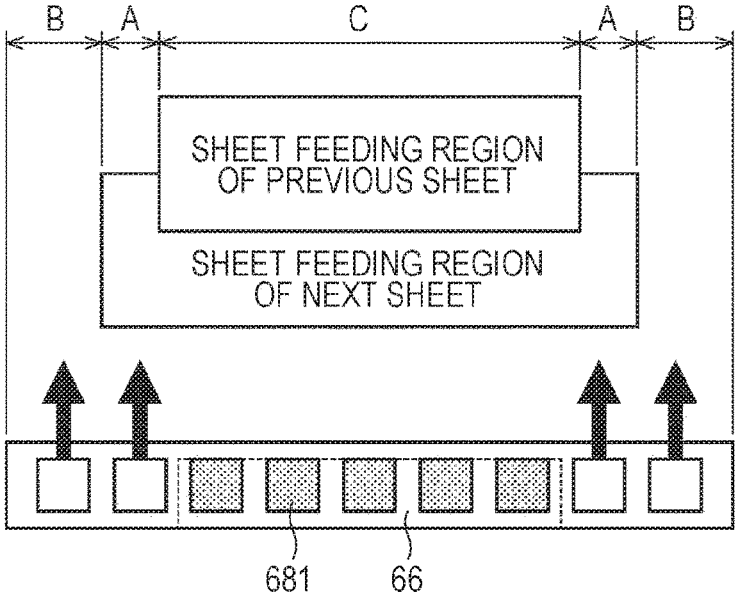

FIGS. 10A and 10B are diagrams showing an example of when all windows 661 corresponding to the overlapping region C are shielded by the first shutter member 681, since the temperature becomes too lower than the predetermined value during cooling of the overlapping region C of the pressurizing roller 42 by a predetermined air blowing volume.

That is, in FIG. 10A, since the temperature of the center portion of the pressurizing roller 42 is in a temperature range not affecting the image quality, the opening ratio of the window 661 in the overlapping region C is set to about 50%. However, when the temperature of the center portion of the pressurizing roller 42 is lower than the appropriate range, the window 661 in the overlapping region C may be shielded by 100% by the first shutter member 681 as shown in FIG. 10B.

Since the air blowing volume of the fan device 65 is constant, as a result of shielding of the window 661 in the overlapping region C, the air blowing volumes to the difference region A and the non-sheet feeding region B further increase, and the cooling effect in this region can be enhanced.

The fact that the temperature of the pressurizing roller 42 in the overlapping region C drops down is considered to be one of the reasons that the number of small size sheets to be fixed is large. It is considered that, during that time, the temperature in the difference region A that is the non-sheet feeding region for the small size sleets in which the temperature has not taken away by the sheet, further increases.

Thus, it is preferable that the air blowing volume of the difference region A increases as described above.

In order to increase the air blowing volume in the difference region A, control may be performed so as to reduce the opening ratio of the window 661 in the overlapping region C as described above, and increase the output of the fan device 65.

(2) In the above embodiment, the air blowing volumes of the difference region A and the non-sheet feeding region B are equalized. However, when the temperature of the difference region A is abnormally high, it is preferable that cooling of the difference region A is prioritized over the non-sheet feeding region B, so that the image noise is prevented.

In the present modification, a temperature sensor that detects the surface temperature of the pressurizing roller 42 in the difference region A is provided, and the cooling volume in the difference region A is particularly controlled based on the result.

Figure 11:
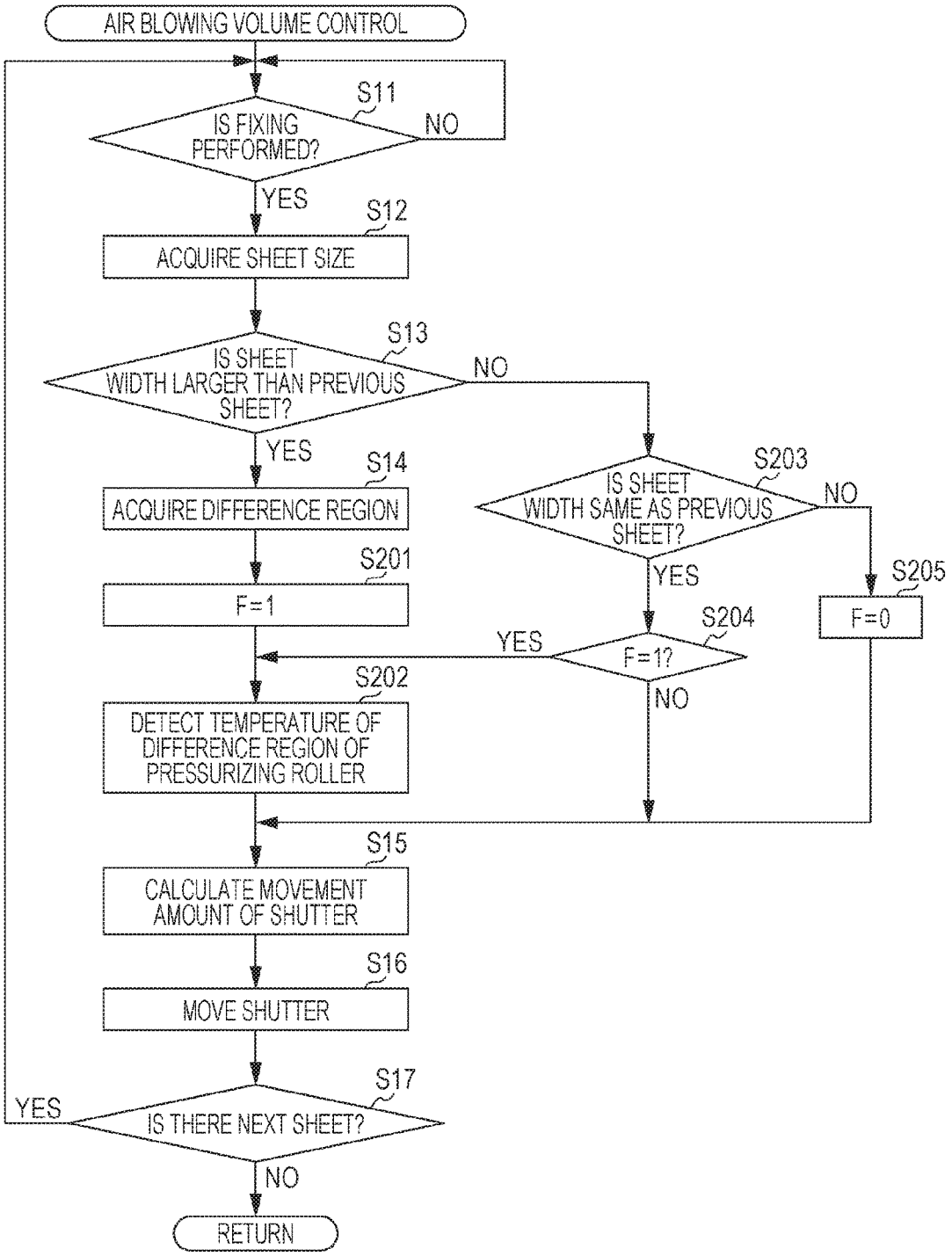
FIG. 11 is a flowchart showing contents of a second modification of the air blowing volume control of the cooling device.

FIG. 11 is a flowchart showing the procedure of the air blowing volume control performed by the control part 50 in the present modification.

The difference from the flowchart of FIG. 8 is that steps S201 to S205 are inserted in the middle of the flowchart.

When it is determined in step S13 that the sheet width of the next sheet is larger than the sheet width of the previous sheet (YES in step S13), the difference region A is acquired (step S14) and a flag F is set to "1". This flag is stored, for example, in the RAM 53.

Then, the surface temperature in the difference region A of the pressurizing roller 42 is detected (step S202).

In calculation of the movement amount of the shutter in step S15, when the detected temperature in step S202 described above is higher than predetermined temperature (for example, 150° C.), the movement amount of the first to third shutter members 681 to 683 is determined so that a relationship of "the air blowing volume in the difference region A>the air blowing volume in the non-sheet feeding region B>the air blowing volume in the overlapping region C" is satisfied.

In step S16, the movement of the corresponding shutter member is performed based on the movement amounts of the first to third shutter members 681 to 683 determined in step S15 described above.

If there is a next sheet (YES in step S17), the flowchart is circulated, and when it is determined that the sheet width of the next sheet is not larger than the sheet width of the previous sheet in step S13 (NO in step S13), and further, whether the sheet widths of the previous sheet and the next sheet are the same is determined (step S203), and when they are the same (YES in step S203), whether the flag F=1 is satisfied is determined (step S204). If F=1 is satisfied (YES in step S204), temperature detection of the difference region A of winch temperature is already detected, is performed again (step S202), and the movement amount of the shutter is calculated based on the temperature result (step S15).

If the detected temperature in step S202 becomes lower than predetermined temperature (for example, (120°) C), the movement amounts of the first to third shutter members 681 to 683 are calculated so that the air blowing volume of the state shown in FIG. 6A, or the air blowing volumes of the difference region A and the overlapping region C are equalized with each other.

When it is determined in step S203 that the sheet width of the next sheet is not the same as the sheet width of the previous sheet, that is, the sheet width of the next sheet is smaller (NO in step S203), the difference region A becomes the non-sheet feeding region of the next small size sheet. Thus, the process proceeds to step S205, the flag F is set to "0", step S202 for detecting the temperature of the difference region is skipped, and calculation of the movement amount of the shutter for the small size sheet is performed (step S15). That is, the movement amount of each shutter is calculated so that the air blowing volume of the non-sheet feeding region is larger than the air blowing volume of the sheet feeding region of the small size sheet, by a predetermined amount.

When it is determined in step S204 that the flag F=1 is not satisfied (NO in step S204), step S202 for detecting the temperature of the difference region is skipped, and the moving amount of each shutter is calculated so that, with respect to the sheet width of the current sheet, the air blowing volume of the non-sheet feeding region is larger than the air blowing volume of the sheet feeding region, by a predetermined amount (step S15).

In step S16, the movement of the corresponding shutter member is performed based on the movement amounts of the first to third shutter members 681 to 683 determined in step S15 described above.

Since the other steps are the same as those in FIG. 8, the description thereof will be omitted.

Figure 12A:
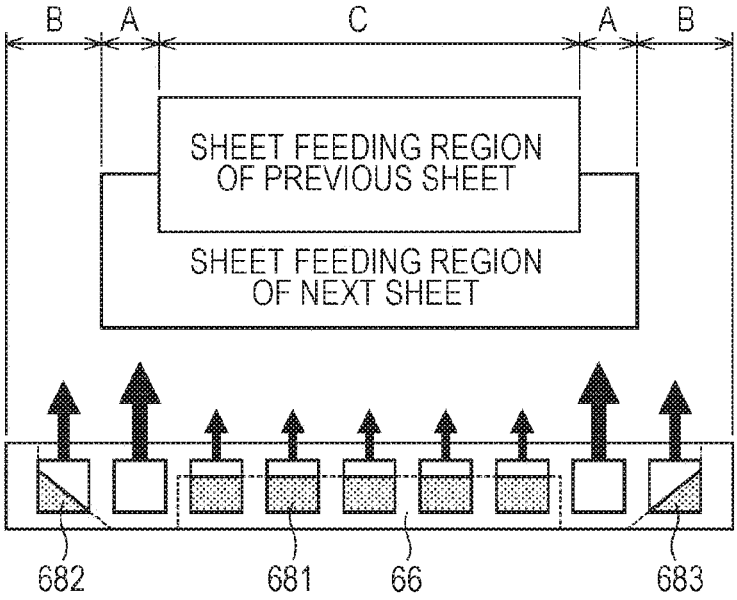
FIGS. 12A and 12B are diagrams schematically showing the air blowing volume controlled in the second modification.
Figure 12B:
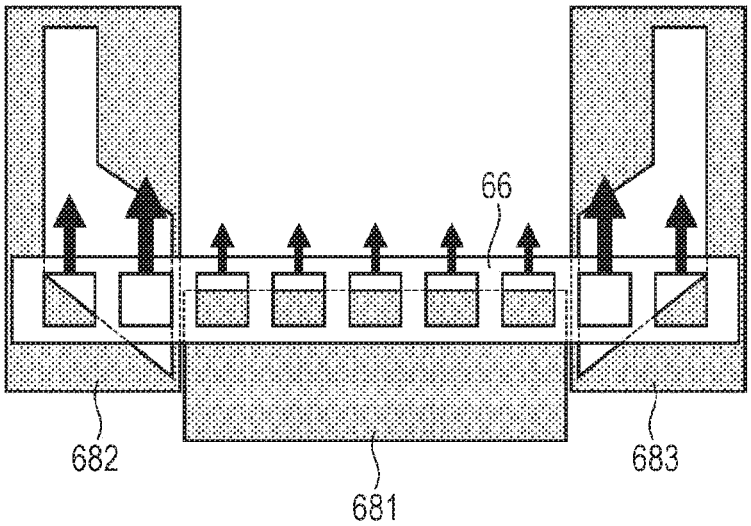

FIGS. 12A and 12B are schematic diagrams showing an example of a case where the air blowing volume of each part is controlled by the first to third shutter members 681 to 683, since the temperature in the difference region A of the pressurizing roller 42 is higher than a predetermined value.

As shown in FIG. 12A, the window 661 in the difference region A is fully opened by the second and third shutter members 682, 683, and the window 661 in the non-sheet feeding region B is shielded by about half (see a development view of the first to third shutter members 681 to 683 of FIG. 12B).

At this time, the shielding rate of the window 661 by the first shutter member 681 is set so as to be larger than the shielding rate of the window 661 in the non-sheet feeding region B. This is because the temperature of the non-sheet feeding region B is higher than that of the overlapping region C. and the necessity of cooling is high.

Since the air blowing volume from the fan device 65 is constant, by setting the opening state of each window 661 as described above, the air blowing volume in the difference region A becomes the largest, and the cooling effect in this portion can be enhanced.

(3) When the job to be performed is a mixed job, in a model capable of selecting a speed priority mode (a mode in which print speed is prioritized) and an image quality priority mode (a mode in which fixing image quality is prioritized over the print speed), the air blowing volume control may be performed as follows.

In this modification, a temperature sensor for detecting the surface temperature of the pressurizing roller 42 in at least the difference region A and the overlapping region C is installed.

Figure 13:
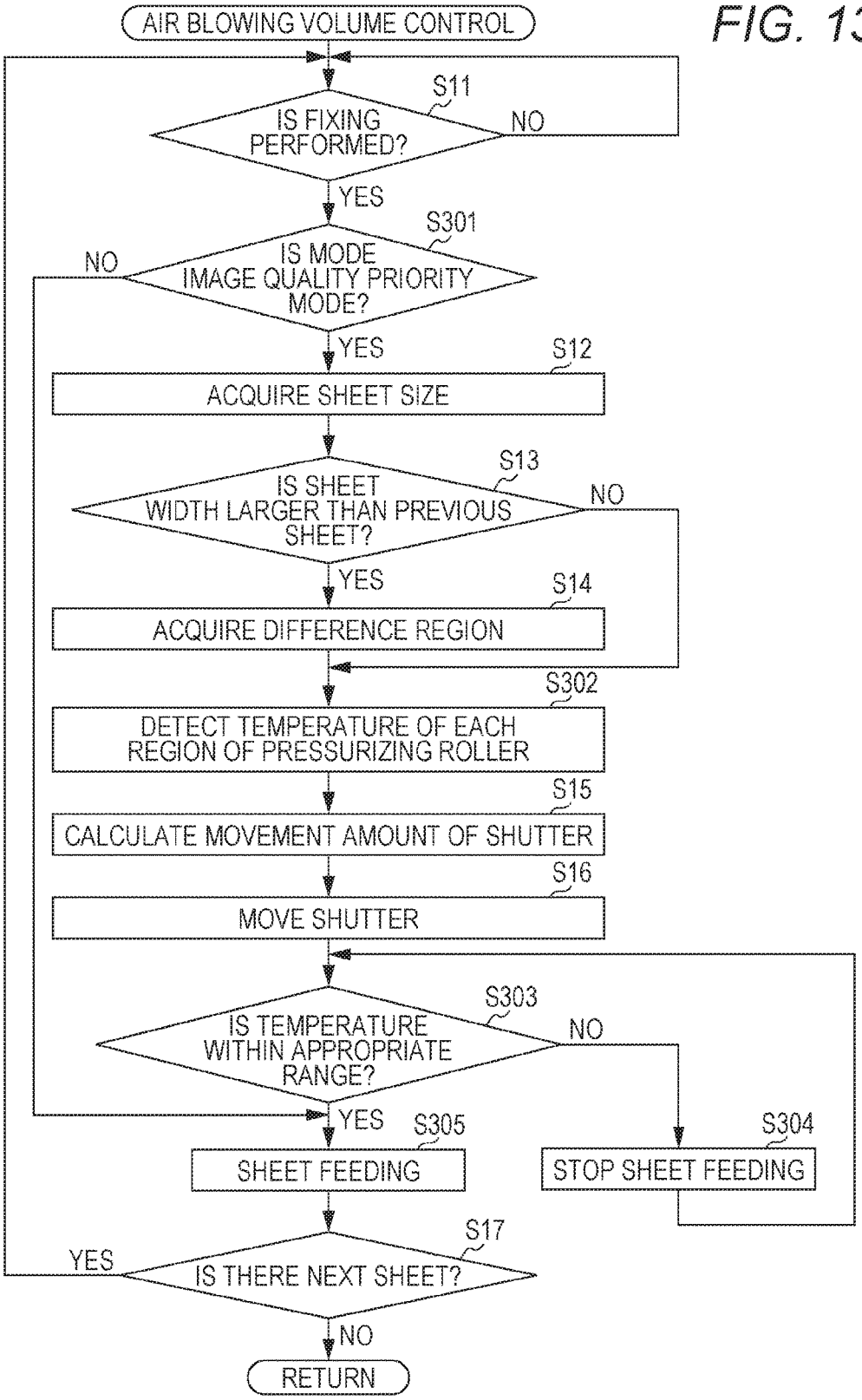
FIG. 13 is a flowchart showing contents of a third modification of the air blowing volume control of the cooling device.

FIG. 13 is a flowchart showing the procedure of the air blowing volume control performed by the control part 50 in the present modification.

First, whether fixing is to be performed is determined (step S11). In this modification, a sheet feeding sensor is arranged immediately front of the registration roller 34 in the upstream side in the sheet conveyance direction, and when the leading end of the next sheet is detected by the sheet feeding sensor, it is determined that the fixing of the sheet is performed.

When fixing is performed (YES in step S11), whether the current print mode is the image quality priority mode is determined (step S301).

Selection between the image quality priority mode and the speed priority mode may be made by the user through the operation panel 70 or may be instructed by the printer driver when a print job is issued from the terminal. Alternatively, the control part 50 may analyze the type (for example, a photo image or a text image) of the image of each page in a print job or a copy job, to set the mode to the image quality priority mode in the case of a photographic image, and set the mode to the speed priority mode in the case of a text image.

In step S301, when the image quality priority mode is not selected, that is, when the speed priority mode is selected (NO in step S301), the sheet is fed as it is and the fixing job is performed (step S305).

When it is determined in step S301 that the image quality priority mode is selected (YES in step S301), the size of the sheet to be fixed next is acquired (step S12), and when the size is larger than the sheet width of the previously fixed sheet (YES in step S13), the difference region is acquired (step S14), and the surface temperature of the pressurizing roller 42 in each of the difference region A and the overlapping region C is detected (step S302).

The movement amounts of the first to third shutter members 681 to 683 are calculated based on the detected temperature (step S15).

For example, a table showing the shielding rate of each of the first to third shutter members 681 to 683 is stored in the ROM 54 according to the temperature range of each of the regions A, C, and the CPU 51 calculates the movement amount of each shutter on the basis of the table.

Then, each of the first to third shutter members 681 to 683 is moved by the calculated movement amount (step S16).

Next, whether the temperature in the difference region A and the overlapping region C is within the appropriate range is determined (step S303). When the temperature is within the appropriate range (YES in step S303), the paper is fed as it is (step S305), and the fixing job is performed.

When it is determined in step S303 that the temperature is not within the appropriate range (NO in step S303), sheet feeding of the next sheet to the fixing part 40 is stopped (step S304), and whether the temperature is within the appropriate range is determined again (step S303). When the temperature is within the appropriate range (YES in step S303), the paper is fed and the fixing job is performed (step S305).

The stop of paper feeding to the fixing part 40 in step S304 is performed by lengthening the stop time of the registration roller 34 and stopping image forming operation in the process units 20Y to 20K.

When it is determined in step S303 that the surface temperature of the pressurizing roller 42 in the difference region A and the overlapping region C is within the appropriate range (YES in step S303), the image forming operation in the process units 20Y to 20K is started, and the rotation of the registration roller 34 is started in accordance with the timing at which the color image transferred to the intermediate transfer belt 26 reaches the transfer position, so that the next sheet is fed to the fixing part 40 (step S305).

In step S301, when it is determined that the width of the next sheet is not larger than the width of the previous sheet (NO in step S301), step S14 is skipped.

In this case, since there is no difference region A, in step S15, the movement amount of the shutter is calculated only by the temperature of the overlapping region C.

After the above processing is performed, the presence of the next sheet is determined (step S17). When there is a next sheet (YES in step S17), the process returns to step S11 and steps of thereafter are repeated. When it is determined that there is no next sheet in step S17 (NO in step S17), the process returns to the main flowchart.

Since the difference region A of the pressurizing roller 42 having the highest temperature most influences on the image quality, only the surface temperature in the difference region A may be detected in step S302, and in step S303, whether the temperature in the difference region A is within the appropriate range may be determined.

In the present modification, the determination step of whether the mode is the image quality priority mode of step S301 may be moved so as to be performed next to the shutter movement step of step S16.

In this case, regardless of whether the mode is the image quality priority mode or not, after steps S11 to S14, S302, and S15 to S16 are performed first, then, whether the image quality priority mode is set is determined, and steps S303 and S304 are performed only when the image quality priority mode is set. When the image quality priority mode is not set, that is, in the case of the speed priority mode, steps S303 and S304 are skipped.

(4) In addition to the above embodiment or modifications (1) to (3), a temperature sensor that detects the surface temperature of the non-sheet feeding region B of the pressurizing roller 42 is provided, and the air blowing volume of the cooling device 60 may be controlled on the basis of the detection result of this temperature sensor, so that the temperature of the non-sheet feeding region B is within the predetermined appropriate temperature range.

(5) In the above embodiment, the air blowing volume of the cooling device 60 can be uniformly changed by the first shutter member 681 for the sheet feeding region for the small size sheet width, and the air blowing volume of the difference region and the non-sheet feeding region for the large size sheet can be changed by the second and third shutter members 682, 683. According to this, in the case of using sheets of two kinds of sheet widths, the control of the air blowing volume is limited.

When sheets of three or more kinds of sheet widths are used, it is desirable that the air blowing volume can be controlled in a finer region.

Figure 14:
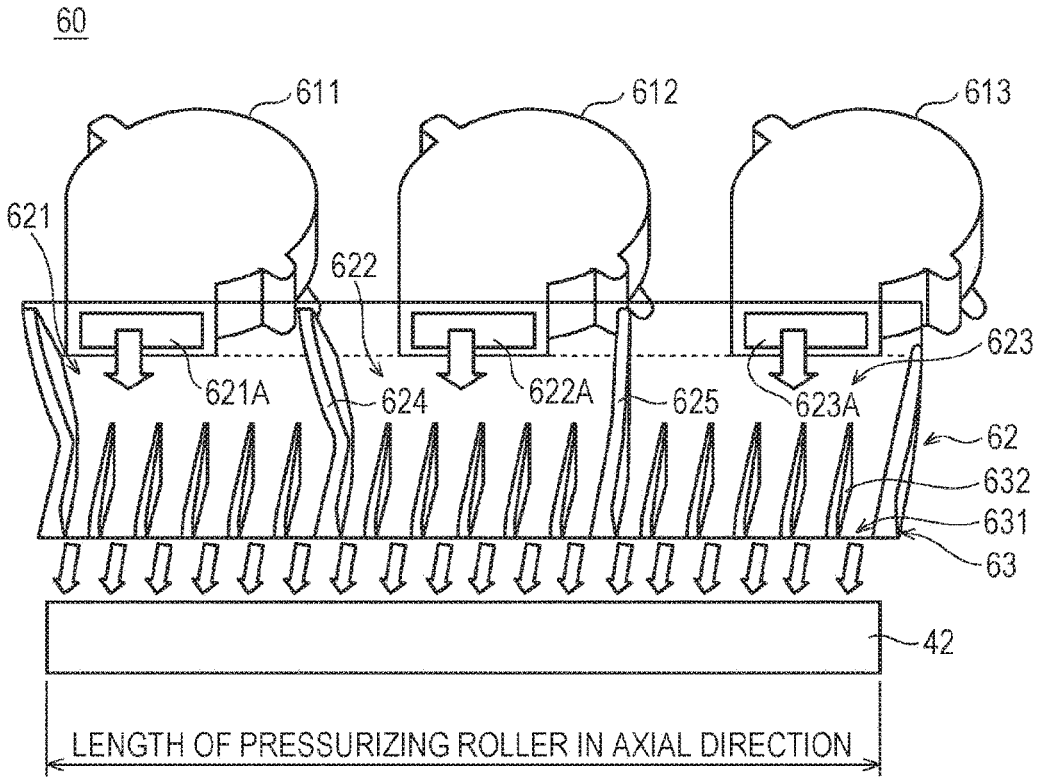
FIG. 14 is a schematic view showing a modification of the cooling device.

FIG. 14 is a schematic view showing the configuration of the cooling device 60 according to the present modification, and the portion of the duct 62 is shown with a side plate on the front side of the drawing removed for easy understanding of the internal structure.

As shown in the drawing, the width in the axial direction of the pressurizing roller 42 at a blowing port of the duct 62 of the cooling device 60 according to the present modification is substantially the same as the roller portion of the pressurizing roller 42, the inside of the duct 62 is divided into three sub ducts 621, 622, 623 by partition walls 624, 625, and air blowing ports of the fan devices 611 to 613 are connected to the openings 621A to 623A of the respective sub ducts.

A nozzle portion 63 at the tip of each of the sub ducts 621 to 623 is divided into six small nozzles 631 by a plurality of partition walls 632, respectively, whereby eighteen small nozzles 631 in total are arranged side by side along the sheet width of the maximum size.

Each small nozzle 631 is provided with an opening and closing mechanism for opening and closing the air blowing port.

Figure 15:
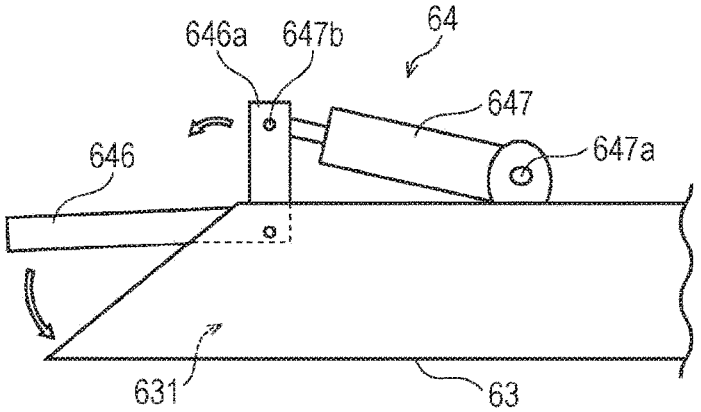
FIG. 15 is a schematic view showing a mechanism for adjusting the air blowing volume at each discharge port in the modification of FIG. 14.

FIG. 15 is a schematic view of when the nozzle portion 63 of the duct 62 is viewed from the right direction in FIG. 14 in order to explain the configuration of the opening and closing mechanism 64.

As shown in the drawing, the opening and closing mechanism 64 includes a shutter member 646 swingably provided at a tip opening portion of the small nozzle 631, a swing lever 646*a* attached to the shutter member 646, and an actuator 647 in which a base end portion is pivotally supported by a support axis 647*a* with respect to the small nozzle 631, and a tip of the rod portion is connected to an end portion of the swing lever 646*a* by a pin 647*b*.

The air blowing volume from the small nozzle 631 is controlled by tilting the swing lever 646*a* in the left direction in the drawing by the actuator 647 by a predetermined amount.

The type of the actuator 647 is not limited, and any kind of mechanism may be used as long as it is a mechanism for driving the shutter member 646 to open or close, in which, for example, a linear motor, a motor and a cam mechanism, a crank mechanism, a screw feeding mechanism or the like are combined.

The air blowing volume can be selectively changed by an instruction from the control part 50 by the fan devices 611 to 613 and the opening and closing mechanism 64 provided at the tip opening portion of each small nozzle 631. Thus, even when a small size sleet is changed to a large size sheet with respect to sheets of different kinds of sheet widths, an appropriate air blowing volume in the overlapping region, the difference region, and the non-sheet feeding region can be set.

As the shutter member 646, a configuration similar to that of a diaphragm mechanism of a camera can be used. The shutter member 646 may be disposed so as to be slidable in the vertical direction.

In the present modification, although three fan devices are used, one fan device may be used as in the embodiment.

(6) When the cooling device 60 capable of controlling the air blowing volume for each small nozzle is used as in the modification of above (5), the air blowing volume can be controlled in consideration of the toner amount (toner density) transferred onto the sheet as follows.

Figure 16:
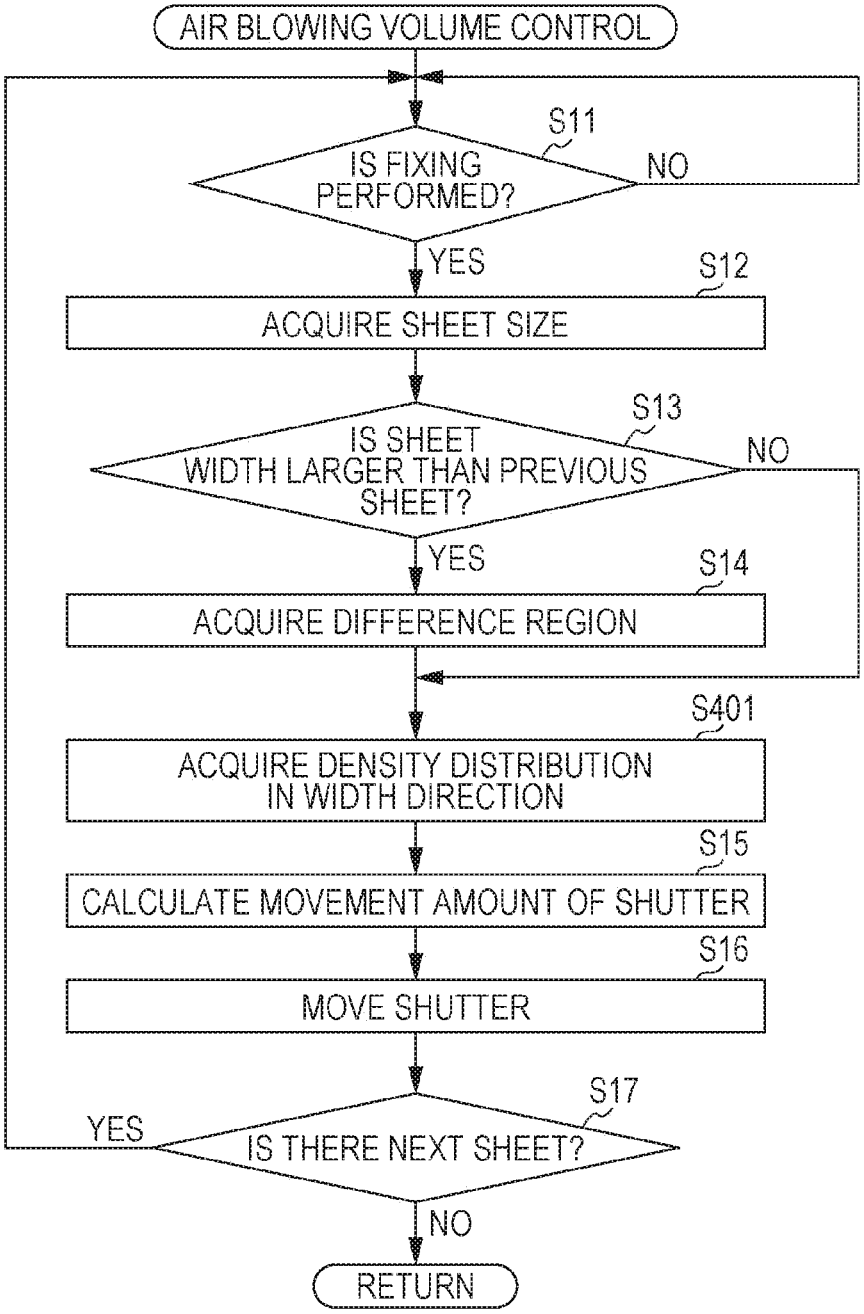
FIG. 16 is a flowchart showing contents of a fourth modification of the air blowing volume control of the cooling device.

FIG. 16 is a flow chart showing the procedure of air blowing volume control according to the present modification.

What is different from the flowchart of FIG. 8 in the embodiment is: that density distribution acquisition processing (step S401) in the width direction is provided after the difference region acquiring processing of step S14, and the contents of calculating processing of the movement amount of the shutter in step S15.

That is, when it is determined in step S13 that the sheet width of the next sheet is larger than the sheet width of the previous sleet (YES in step S13), the difference region between the small size sheet and the large size sheet is acquired (step S14). Further, a distribution (density distribution) in the sheet width direction (main scanning direction) of the toner amount transferred onto the next large size sheet is acquired.

With respect to RIP data of the image formed on the sheet, the density distribution is obtained by integrating the density value of each pixel in the sub-scanning direction, creating a density histogram in the main scanning direction, comparing the density histogram with a predetermined threshold, and segmenting the density histogram into some stages from a low density region to a high density region.

The density distribution is created by the CPU 51 of the control part 50 based on the image data received from the terminal, the image data read by the scanner, or the image data already stored and filed in the image memory, in the case of a print job. The toner image formed on the intermediate transfer belt 26 (FIG. 1) may be read by a line sensor or the like so that the density data is obtained.

In step S15, the movement amount of each shutter member is calculated based on the range of the difference region and the density distribution.

Figure 17:
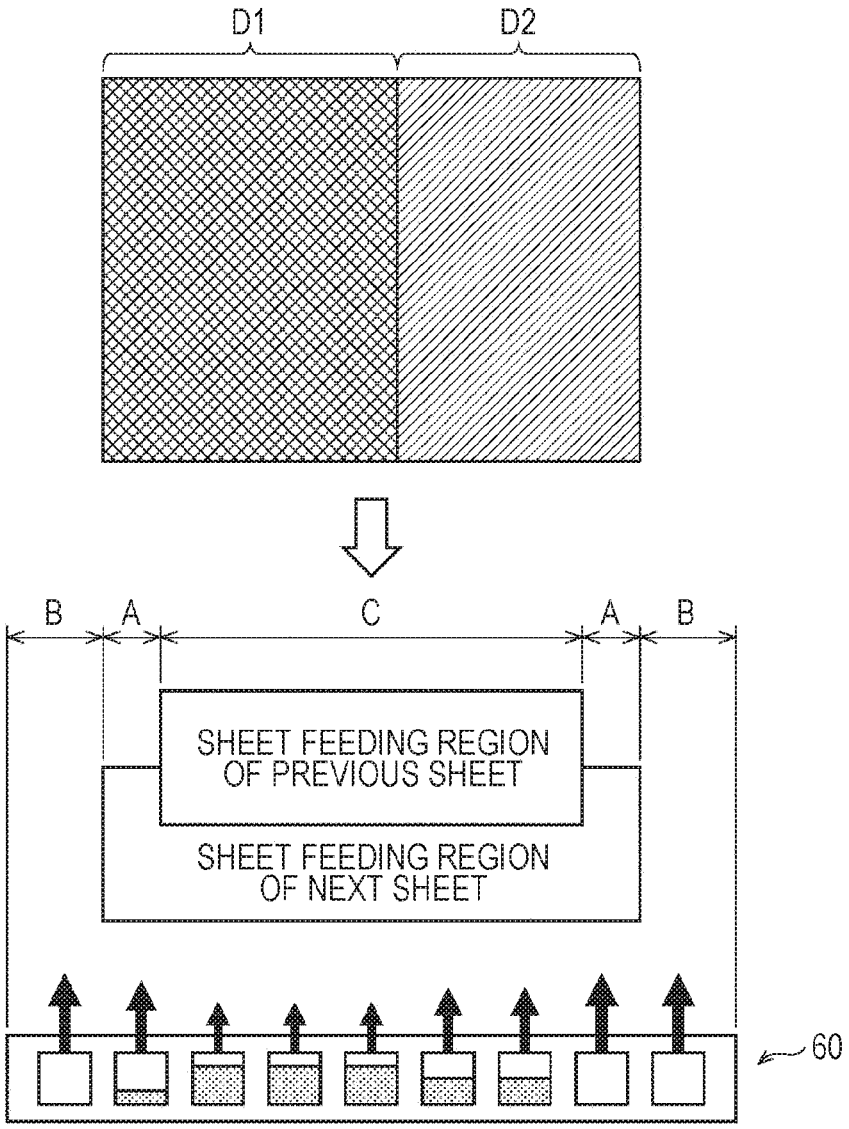
FIG. 17 is a schematic diagram showing an example of changing the air blowing volume of the cooling device according to a difference in toner density.

FIG. 17 is a schematic diagram showing the size relationship between the air blowing volumes from each air blowing port in the case where the density distribution in the main scanning direction is divided into two density regions of a high density region D1 and a low density region D2 with reference to a certain threshold, in the present modification.

As shown in the drawing, in step S15, the movement amount of the shutter is determined according to the following rule.

(a) The air blowing volume of the difference region A is larger than the air blowing volume of the overlapping region C.

(b) The air blowing volume for the low density region (low density region D2) of the sheet feeding region of the large size sheet (A+C) is larger than the air blowing volume for the high density region (high density region D1).

(c) The air blowing volume of the non-sheet feeding region B of the large size sheet is larger than the air blowing volume to the overlapping region C.

The reason why the air blowing volume in the low density region D2 is made larger than the air blowing volume in the high density region D as in above (b) is because a large amount of heat is absorbed by the amount of adhered toner, and thereby, it is not necessary to cool the high density region D1, as much as the low density region D2.

Returning to FIG. 16, in step S16, each shutter member is moved based on the movement amount calculated in the manner described above in step S15, and air blowing is performed.

Since the other steps are the same as those in FIG. 8, the description thereof will be omitted.

Such air blowing volume control is particularly effective for an image in which a photographic image and a text image are separately displayed in the main scanning direction.

(7) In the above embodiment, when the width of the next sheet is wider than the previous sheet, when the leading end of the next sheet is detected by the sheet feeding sensor 401, the air blowing volume in the difference region A is controlled to be larger than the air blowing volume in the overlapping region C.

However, for example, when a print job accepted from another terminal is performed, in what number of sheets the sheet is changed from the small size sheet to the large size sheet can be acquired in advance by the control part 50. Thus, the portion to be the difference region in the non-sheet feeding region of the small size sheet may be cooled slightly stronger than the other non-sheet feeding regions, from when the fixing job of the small size sheet is performed.

(8) In the above embodiment, as shown in FIG. 1, the cooling device 60 is disposed at a position to cool an opposite portion from the nip part of the pressurizing roller 42, but the present invention is not limited thereto.

However, when the cooling device 60 is provided in the vicinity of the position where the sheet enters the nip part, air striking the peripheral surface of the pressurizing roller 42 flows upward along the peripheral surface and hits against the leading end of the sheet. Thus, the sheet may flap to damage the leading end of the sheet. Conversely, when the cooling device 60 is provided in the vicinity of the sheet discharge side of the nip part, the sheet after fixing flaps, and when a sheet is still present in the nip part, the sheet may flap, which may cause fixing failure and image disturbance. Thus, it is desirable that the cooling device 60 is disposed at a position that has as little influence on sheet conveyance as possible.

However, air is inevitably likely to be pulled along the direction of rotation of the pressurizing roller 42, and the air from the cooling device 60 may be carried in a direction in which the sheet enters the nip part.

Therefore, just before the leading end of the sheet enters the nip part, the air blowing volume may be controlled to be temporarily reduced. The region for reducing the air blowing volume may be the entire region of the pressurizing roller 42 or may be the region where the air blowing volume is relatively large.

For example, the air blowing volume of the cooling device 60 may be controlled to be entirely (or partly) reduced during time t (this time t is determined in advance by dividing the conveyance path length from a detection position by the sheet feeding sensor 401 to the nip part by conveyance speed, and is stored in the ROM 54) from after the leading end of the sheet is detected by the sheet feeding sensor 401 (FIG. 1) that is before the nip of the fixing part 40, to when the leading end of the sheet is nipped by the nip part.

Figure 18:
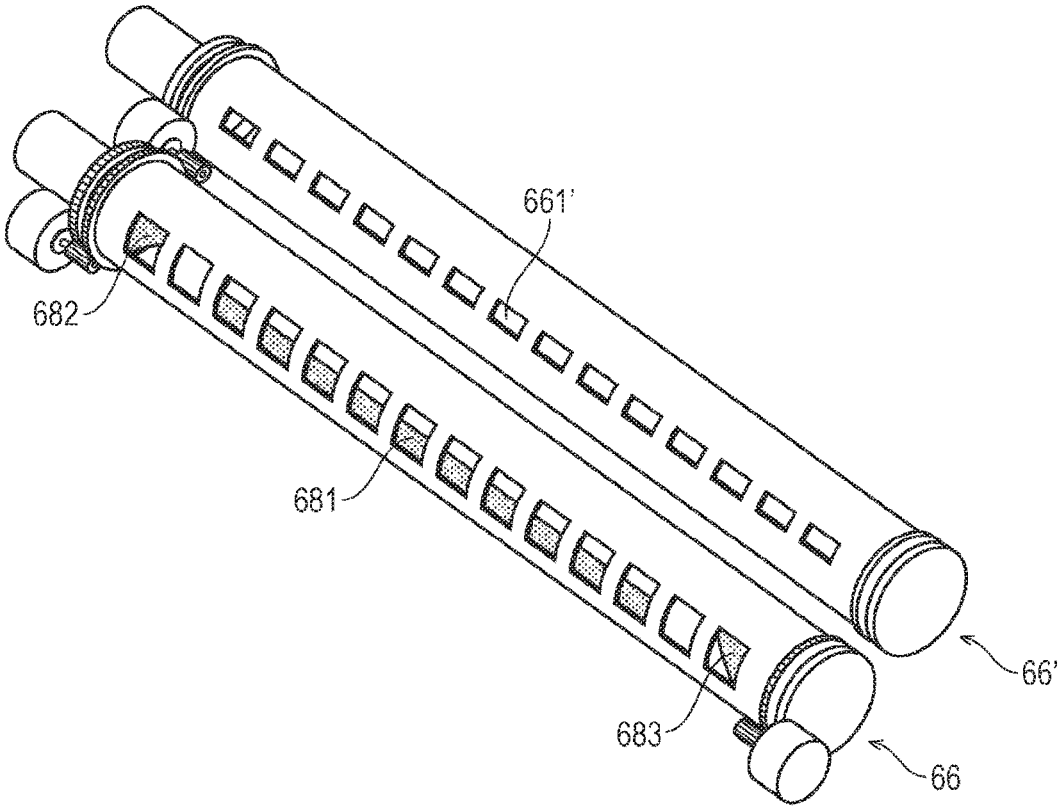
FIG. 18 is a perspective view showing another modification of the cooling device.

(9) In the above embodiment, although only one air blowing sleeve 66 is provided in the cooling device 60, another air blowing sleeve 66' may be disposed parallel to the air blowing sleeve 66 as shown in FIG. 18. In the present modification, a movable shutter is not provided over windows 661' in the air blowing sleeve 66', a constant air blowing volume is always maintained over the entire length of the pressurizing roller 42, and the first to third shutter members 681 to 683 in the air blowing sleeve 66 are moved to change the air blowing volume.

Figure 19A:
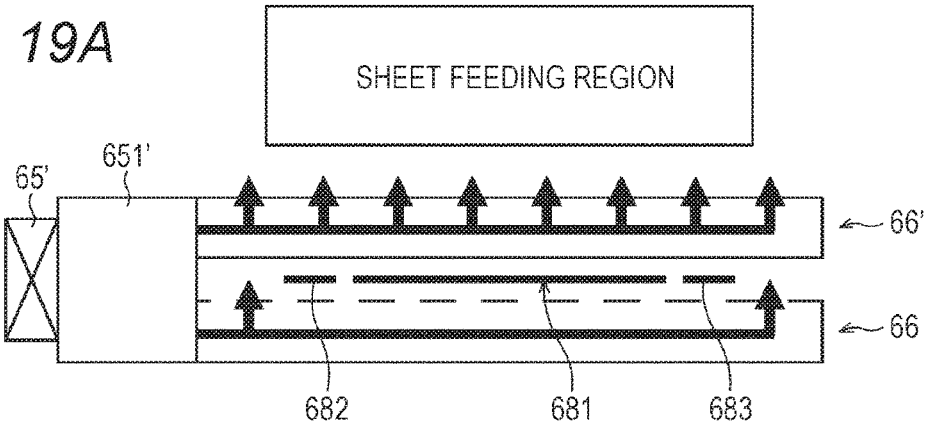
FIGS. 19A to 19C are schematic diagrams showing control examples of the air blowing volume of when the pressurizing roller is cooled by the cooling device of FIG. 18.
Figure 19B:
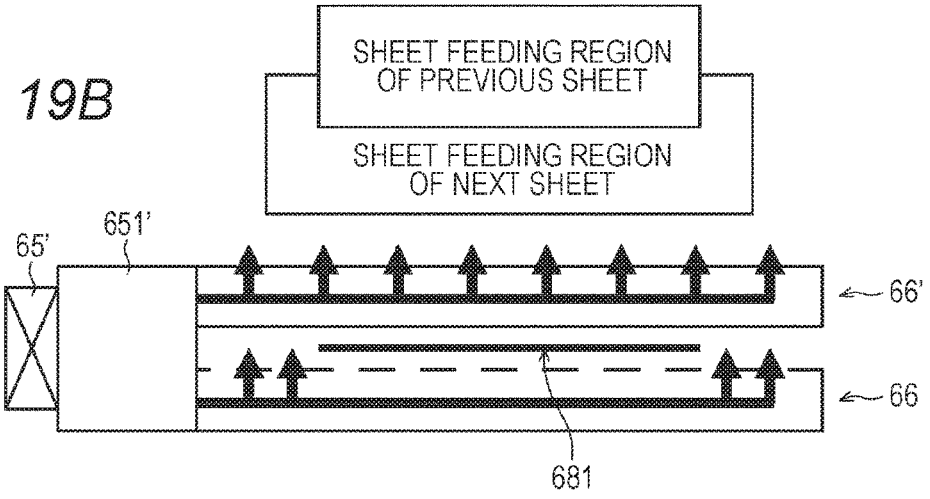
Figure 19C:
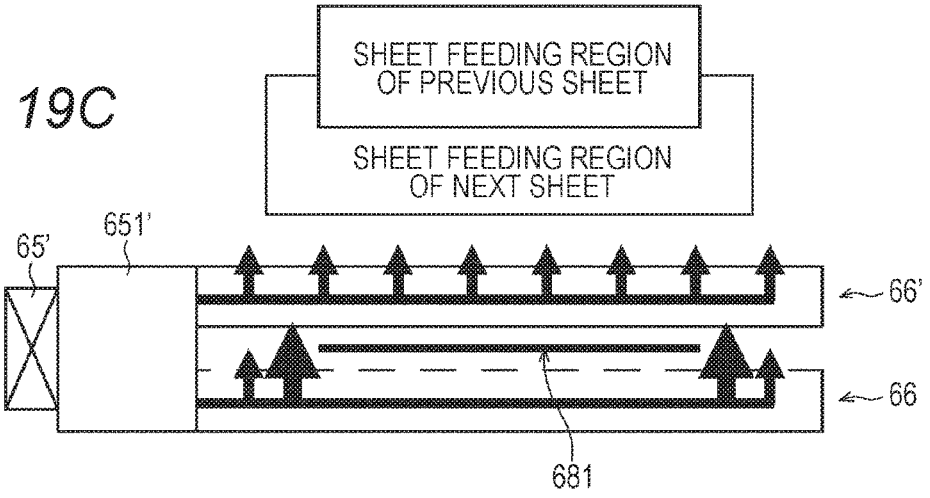

FIGS. 19A to 19C are schematic diagrams showing an example of control of the air blowing volume in the present modification. The air blown from a fan device 65' is split into air blowing sleeves 66, 66' via a common duct 651', and cools the surface of the pressurizing roller 42 with the air volume according to the opening area of each window.

FIG. 19A shows an example in which the cooling of the non-sheet feeding region for the large size sheet is made larger than the cooling of the sheet feeding region. FIG. 19B corresponds to the air blowing volume control in FIGS. 6A and 6B. FIG. 19C corresponds to the air blowing volume control in 12A.

A movable shutter is provided in the air blowing sleeve 66' as similar to the air blowing sleeve 66, the shielding ranges of the shutters in the longitudinal direction of the air blowing sleeve 66' are set to be different from the first to third shutter members 681 to 683, and thereby, the control of the air blowing volume can be more diversified.

(10) In the above embodiment, the description has been made mainly on the air blowing volume control at the time of performing the mixed job. However, similar control can be performed even when, after the series of first jobs on the small size sheet are performed, another second job is performed for the large size sheet.

(11) In the above embodiment, an example of the fixing apparatus using the heating roller 41 and the pressurizing roller 42 as the heating member and the pressurizing member has been described. However, the fixing apparatus may have a configuration in which a fixing belt and a long pad-like pressurizing member form the nip part. The heat source is not limited to the halogen heater, and may be a method of electromagnetic induction heating the heat generation layer of the fixing belt by using an excitation coil, a method of heating the heating roller with a resistance heating element, or the like.

In short, any type of fixing apparatus can be applied as long as the fixing apparatus has a configuration in which a nip part is formed by a heating member and a pressurizing member that are long and disposed in parallel with each other, and a sheet is fed to the nip part and fixed.

(12) In the above embodiment, control of the air blowing volume in the fixing job of two kinds of sheet widths has been described. However, even when the kinds of sheet widths are three or more, if the sheet width of the next sheet is larger than the sheet width of the previous sheet, only the ranges of the difference region A, the non-sheet feeding region B, and the overlapping region C differ according to the difference of the sheet widths. Thus, the present invention can be applied. Particularly, when the modifications shown in FIG. 11 and FIG. 13 are performed, since the difference region A differs depending on the combination of the sheet widths, there is a case where a plurality of temperature sensors are required to detect the temperature of the different difference regions A.

(13) In the above embodiment, a tandem type color copying machine has been described. However, the present invention is not limited thereto, and a facsimile machine or a printer exclusive machine may be used as long as it includes a fixing apparatus. A monochrome image forming apparatus also may be used.

(14) Specific values such as an appropriate temperature range, a threshold, a shielding rate of each window described in the above embodiment and modifications can be appropriately determined by those skilled in the art.

The above embodiment and modifications may be freely combined as long as they do not depart from the gist of the present invention. For example, in the embodiment and all modifications, steps similar to steps S303 to S305 in FIG. 13 can be provided irrespective of whether or not the image quality priority mode is set, so that the feeding of the next sheet is stopped at least until when the temperature in the difference region A drops to predetermined temperature.

The present invention is suitable as a technique for cooling a pressurizing member in a fixing apparatus to prevent generation of image noise.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing apparatus for feeding a sheet that is unfixed through a nip formed between a heating member and a pressurizing member to thermally fix the sheet, the fixing apparatus comprising a cooler that cools the pressurizing member, the pressurizing member includes a first sheet feeding region having a first width, and a second sheet feeding region having a second width that is wider than the first width, the first sheet feeding region being included in the second sheet feeding region;

wherein when a fixing job is performed on a sheet whose sheet width is the second width, after a fixing job is completed on a sheet whose sheet width in an orthogonal direction to a sheet feeding direction is the first width, the cooler;

cools the first sheet feeding region of the pressurizing member through which the sheet having the first width is fed, and cools a difference region, which comprises the second sheet feeding region and does not include the first sheet feeding region, with a cooling power stronger than that of a region corresponding to the first sheet feeding region.

2. The fixing apparatus according to claim 1, wherein the cooler cools the difference region in the pressurizing member and a non-sheet feeding region of the sheet having the second width, with the same cooling power, the non-sheet feeding region comprising a portion of the pressurizing member that extends beyond the second width.

3. The fixing apparatus according to claim 1, further comprising a density distribution acquisitor that acquires a density distribution of a toner image transferred onto a sheet to be fixed next in a longitudinal direction of the pressurizing member, wherein the cooler sets a cooling power for a region of a first density range to be larger than a cooling power for a region of a second density range with higher density than the first density range.

4. The fixing apparatus according to claim 1, wherein the cooler changes a cooling power by changing an air volume to be blown to each region of the pressurizing member.

5. The fixing apparatus according to claim 4, wherein the cooler has a plurality of air blowing ports arranged in parallel with a longitudinal direction of the pressurizing member, and changes the cooling power by adjusting the air volume blown from the plurality of air blowing ports.

6. The fixing apparatus according to claim 5, wherein the cooler includes a shutter member for shielding each of the air blowing ports, and the air volume is adjusted by moving the shutter member to change a shielding rate of each of the air blowing ports.

7. The fixing apparatus according to claim 6, wherein the plurality of air blowing ports are formed in a row in a position opposed to the pressurizing member on a peripheral surface of an air blowing sleeve arranged in parallel with the pressurizing member, the shutter member includes a cylindrical member arranged coaxially with a cylindrical sleeve, and the air volume from each of the air blowing ports is adjusted by rotating and moving the shutter member.

8. An image forming apparatus comprising the fixing apparatus according to claim 1.

9. The fixing apparatus according to claim 1, further comprising a difference region temperature detector that detects a temperature of the difference region of the pressurizing member, wherein the cooler performs cooling so that a cooling power for the difference region is greater than the cooling power for a non-sheet feeding region of the sheet having the second width until the temperature detected by the difference region temperature detector reaches a predetermined temperature, the non-sheet feeding region comprising a portion of the pressurizing member that extends beyond the second width.

10. The fixing apparatus according to claim 1, further comprising a center portion temperature detector that detects temperature of a center portion in a longitudinal direction of the pressurizing member, wherein the cooler controls a cooling power so that temperature in a region corresponding to the first sheet feeding region of the pressurizing member is within a target temperature range based on the temperature detected by the center portion temperature detector.

11. A fixing apparatus for feeding a sheet that is unfixed through a nip formed between a heating member and a pressurizing member to thermally fix the sheet, the fixing apparatus comprising a cooler that cools the pressurizing member, wherein when a fixing job is performed on a sheet whose sheet width is a second width larger than a first width, after a fixing job is completed on a sheet whose sheet width in an orthogonal direction to a sheet feeding direction is the first width, the cooler cools a difference region in which a first sheet feeding region of the pressurizing member through which the sheet having the first width is fed and a second sheet feeding region through which the sheet having the second width is fed are not overlapped with each other, with a cooling power stronger than that of a region corresponding to the first sheet feeding region, further comprising a difference region temperature detector that detects a temperature of the difference region of the pressurizing member, wherein the cooler performs cooling so that a cooling power for the difference region is greater than the cooling power for a non-sheet feeding region of the sheet having the second width until the temperature detected by the difference region temperature detector reaches a predetermined temperature, the non-sheet feeding region comprising a portion of the pressurizing member that extends beyond the second width.

12. A fixing apparatus for feeding a sheet that is unfixed through a nip formed between a heating member and a pressurizing member to thermally fix the sheet, the fixing apparatus comprising a cooler that cools the pressurizing member, wherein when a fixing job is performed on a sheet whose sheet width is a second width lamer than a first width, after a fixing job is completed on a sheet whose sheet width in an orthogonal direction to a sheet feeding direction is the first width, the cooler cools a difference region in which a first sheet feeding region of the pressurizing member through which the sheet having the first width is fed and a second sheet feeding region through which the sheet having the second width is fed are not overlapped with each other, with a cooling power stronger than that of a region corresponding to the first sheet feeding region, further comprising a center portion temperature detector that detects temperature of a center portion in a longitudinal direction of the pressurizing member, wherein the cooler controls a cooling power so that temperature in a region corresponding to the first sheet feeding region of the pressurizing member is within a target temperature range based on the temperature detected by the center portion temperature detector.

13. The fixing apparatus according to claim 12, wherein when the temperature detected by the center portion temperature detector is lower than a lower limit of the target temperature range, the cooler sets a cooling power for a region corresponding to the first sheet feeding region of the pressurizing member to be smaller, and sets a cooling power for the difference region to be larger.

* * * * *